US008958718B2

(12) United States Patent
Kadota et al.

(10) Patent No.: US 8,958,718 B2
(45) Date of Patent: Feb. 17, 2015

(54) TONER CONTAINER AND IMAGE FORMING APPARATUS

(71) Applicants: Ichiro Kadota, Kanagawa (JP); Kunihiro Ohyama, Tokyo (JP); Masayuki Yamane, Kanagawa (JP); Takeshi Uchitani, Kanagawa (JP); Nobuyuki Taguchi, Kanagawa (JP); Satoru Yoshida, Kanagawa (JP); Takuya Seshita, Kanagawa (JP)

(72) Inventors: Ichiro Kadota, Kanagawa (JP); Kunihiro Ohyama, Tokyo (JP); Masayuki Yamane, Kanagawa (JP); Takeshi Uchitani, Kanagawa (JP); Nobuyuki Taguchi, Kanagawa (JP); Satoru Yoshida, Kanagawa (JP); Takuya Seshita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/066,965

(22) Filed: Oct. 30, 2013

(65) Prior Publication Data

US 2014/0050509 A1 Feb. 20, 2014

Related U.S. Application Data

(63) Continuation of application No. 13/720,628, filed on Dec. 19, 2012, now Pat. No. 8,600,262, which is a continuation of application No. 12/682,895, filed as application No. PCT/JP2009/064082 on Aug. 4, 2009, now Pat. No. 8,369,738.

(30) Foreign Application Priority Data

| | | |
|---|---|---|
| Sep. 9, 2008 | (JP) | 2008-231266 |
| Sep. 12, 2008 | (JP) | 2008-234344 |
| Sep. 26, 2008 | (JP) | 2008-248371 |
| Sep. 29, 2008 | (JP) | 2008-249424 |

(51) Int. Cl.
*G03G 15/08* (2006.01)

(52) U.S. Cl.
CPC .... *G03G 15/0867* (2013.01); *G03G 2221/1823* (2013.01); *G03G 15/0834* (2013.01); *G03G 2215/0692* (2013.01)
USPC ..... 399/106; 399/262

(58) Field of Classification Search
CPC ..... G03G 15/0837; G03G 15/0872; G03G 2215/0678; G03G 2215/0668; G03G 2215/067
USPC ..... 399/106, 119, 262, 263
See application file for complete search history.

(56) References Cited

U.S. PATENT DOCUMENTS

| | | | |
|---|---|---|---|
| 5,630,198 | A | 5/1997 | Makino |
| 6,298,208 | B1 | 10/2001 | Kawamura et al. |

(Continued)

FOREIGN PATENT DOCUMENTS

| | | |
|---|---|---|
| JP | 62-208696 | 9/1987 |
| JP | 10-055103 | 2/1998 |

(Continued)

OTHER PUBLICATIONS

Japanese Office Action mailed May 30, 2013 for Japanese Patent Application No. 2008-231266.

(Continued)

*Primary Examiner* — Gregory H Curran
(74) *Attorney, Agent, or Firm* — Oblon, Spivak, McClelland, Maier & Neustadt, L.L.P.

(57) ABSTRACT

A toner container and an image forming apparatus are disclosed. The toner container includes a guiding member formed at a part surrounding a toner outlet to be protruded from a circumferential surface of the toner container for guiding an opening or closing operation of a shutter member in a circumferential direction of the toner container. The image forming apparatus includes an image forming apparatus main body. The image forming apparatus main body includes a main body side shutter for opening or closing a toner supplying opening to be connected to the toner outlet. When the shutter member is opened, an end surface of the guiding member pushes the main body side shutter together with the opening operation of the shutter member, and the toner supplying opening is opened and is connected to the toner outlet.

17 Claims, 33 Drawing Sheets

(56) References Cited

U.S. PATENT DOCUMENTS

| | | | | |
|---|---|---|---|---|
| 6,336,020 | B1 | 1/2002 | Ishikawa et al. | |
| 6,345,164 | B1 * | 2/2002 | Yokomori et al. | 399/119 |
| 6,389,257 | B1 | 5/2002 | Harumoto et al. | |
| 6,490,422 | B2 | 12/2002 | Harumoto | |
| 6,947,685 | B2 | 9/2005 | Arimitsu et al. | |
| 7,162,189 | B2 | 1/2007 | Tsuda et al. | |
| 7,184,691 | B2 | 2/2007 | Kita et al. | |
| 7,277,664 | B2 | 10/2007 | Katsuyama et al. | |
| 7,321,744 | B2 | 1/2008 | Hosokawa et al. | |
| 7,409,180 | B2 * | 8/2008 | Seo | 399/258 |
| 7,574,162 | B2 | 8/2009 | Yamane | |
| 7,634,204 | B2 | 12/2009 | Ohta | |
| 7,809,313 | B2 | 10/2010 | Kitaoka | |
| 7,826,779 | B2 | 11/2010 | Mase et al. | |
| 7,917,087 | B2 | 3/2011 | Harumoto | |
| 2004/0203413 | A1 | 10/2004 | Harumoto | |
| 2005/0135841 | A1 | 6/2005 | Murakami et al. | |
| 2006/0034642 | A1 | 2/2006 | Taguchi et al. | |
| 2006/0104671 | A1 | 5/2006 | Murakami et al. | |
| 2006/0182469 | A1 | 8/2006 | Koyama et al. | |
| 2007/0154243 | A1 | 7/2007 | Taguchi et al. | |
| 2007/0212119 | A1 | 9/2007 | Kurenuma et al. | |
| 2008/0080903 | A1 | 4/2008 | Noguchi | |
| 2008/0260432 | A1 | 10/2008 | Ohyama et al. | |
| 2009/0087214 | A1 | 4/2009 | Utsunomiya et al. | |
| 2009/0317140 | A1 | 12/2009 | Yoshida et al. | |

FOREIGN PATENT DOCUMENTS

| | | | |
|---|---|---|---|
| JP | 10-171229 | | 6/1998 |
| JP | 2001-013749 | | 1/2001 |
| JP | 2001-075455 | | 3/2001 |
| JP | 2001-083792 | | 3/2001 |
| JP | 2001183895 | A * | 7/2001 |
| JP | 2002062784 | A * | 2/2002 |
| JP | 2003-066703 | | 3/2003 |
| JP | 2004020910 | A * | 1/2004 |
| JP | 3571584 | | 9/2004 |
| JP | 2004-287404 | | 10/2004 |
| JP | 2004-326125 | | 11/2004 |
| JP | 2005-173568 | | 6/2005 |
| JP | 2005-221831 | | 8/2005 |
| JP | 2006-171199 | | 6/2006 |
| JP | 2006-178146 | | 7/2006 |
| JP | 2006-201362 | | 8/2006 |
| JP | 2006-221079 | | 8/2006 |
| JP | 2007-148320 | | 6/2007 |
| JP | 2007-149032 | | 6/2007 |
| JP | 2007-156260 | | 6/2007 |
| JP | 2007-199505 | | 8/2007 |
| JP | 2007199457 | A * | 8/2007 |
| JP | 2007-292968 | | 11/2007 |
| JP | 4014335 | | 11/2007 |
| JP | 2008-083476 | | 4/2008 |
| JP | 2008-096852 | | 4/2008 |
| JP | 2008151968 | A * | 7/2008 |
| JP | 2009-098624 | | 5/2009 |

OTHER PUBLICATIONS

Japanese Office Action mailed May 28, 2013 for Japanese Patent Application No. 2008-248371.

Japanese Office Action mailed May 17, 2013 for Japanese Patent Application No. 2009-172527.

Japanese Office Action mailed Jul. 2, 2013 for Japanese Patent Application No. 2009-172494.

Japanese Office Action mailed Jun. 28, 2013 for Japanese Patent Application No. 2008-023714.

* cited by examiner

TONER CONTAINER AND IMAGE FORMING APPARATUS

CROSS-REFERENCE TO RELATED APPLICATIONS

This application is a continuation of and claims the benefit of priority under 35 U.S.C. §120 from U.S. application Ser. No. 13/720,628, filed Dec. 19, 2012, which is a continuation of Ser. No. 12/682,895, filed Apr. 14, 2010 (Now U.S. Pat. No. 8,369,738), which is a 371 of International Application No. PCT/JP2009/064082, filed Aug. 4, 2009, and claims the benefit of priority under 35 U.S.C. §119 from Japanese Patent Application No. 2008-231266, filed on Sep. 9, 2008, Japanese Patent Application No. 2008-234344, filed on Sep. 12, 2008, Japanese Patent Application No. 2008-248371, filed on Sep. 26, 2008, and Japanese Patent Application No. 2008-249424, filed on Sep. 29, 2008, with the Japanese Patent Office, and the entire contents of each of which are hereby incorporated herein by reference.

TECHNICAL FIELD

The present invention generally relates to a toner container which is attached to an image forming apparatus such as a copying machine, a printer, a facsimile machine, and a multifunctional peripheral having the above functions and an image forming apparatus using the toner container.

BACKGROUND ART

Conventionally, in an image forming apparatus such as a copying machine, a toner container having a cylindrical shape (toner bottle) has been used by being detachably attached to the image forming apparatus (for example, see Patent Document 1).

In Patent Document 1, a toner container (toner bottle), which is detachably attached to an image forming apparatus main body, is mainly formed of a container main body and a cap section. A spiral protrusion is formed on an inner circumferential surface of the container main body, and when the container main body is rotated, toners contained in the container main body are carried to an opening part of the toner container. The cap section is connected to the container main body and is supported by the image forming apparatus main body without being rotated by the rotation of the container main body. The toners output from the opening part of the container main body are output from a toner output opening of the cap section. The toners output from the toner output opening are supplied to a developing device.

In addition, a shutter member for opening or closing the toner output opening is formed in the cap section of the toner container. The shutter member opens or closes the toner output opening by being interfaced with attaching or detaching of the toner container to or from the image forming apparatus main body.

[Patent Document 1] Japanese Unexamined Patent Publication No. 2004-287404

In a case where the toner container in Patent Document 1 is compared with a toner container without having a cap section, when the toner container in Patent Document 1 is replaced with a new one, stains caused by toners can be decreased. That is, since a toner outlet is opened or closed by interfacing with an attaching or detaching operation of the toner container, a user is prevented from being stained by the toners due to a direct touch of the toner outlet. In addition, since the direction of the toner outlet is a direct downward direction, an amount of toners remaining near the toner outlet may be small as a result of being dropped with the toner's own weight when the toners have been almost consumed (at the toner end time). With this, the stains caused by the toners near the toner outlet can be decreased when the container is replaced with a new one.

However, a slight amount of toners is adhered onto a part surrounding the toner outlet, and the adhered toners are dropped into the image forming apparatus main body when the toner container is replaced with a new one. In particular, stains caused by the dropped toners have been remarkable at the part surrounding a toner supplying opening of the image forming apparatus main body. Consequently, an unsatisfying impression has been given to the user.

In order to solve the above problem, it is conceivable that a shutter member is formed to open or close the toner outlet by rotating the toner container in a state where the toner container is attached to the image forming apparatus main body and a main body side shutter is formed to open or close a toner supplying opening of the image forming apparatus main body.

However, in this case, in order not to generate a toner supplying fault to the image forming apparatus main body, the main body side shutter of the image forming apparatus main body must be surely opened together with an opening operation of the shutter member of the toner container, and the toner outlet of the toner container must be surely connected to the toner supplying opening of the image forming apparatus.

SUMMARY OF INVENTION

In a preferred embodiment of the present invention, there is provided a toner container and an image forming apparatus in which a toner supplying fault does not occur from a toner container to an image forming apparatus main body of the image forming apparatus and toners dropped from the toner container to a part surrounding a toner supplying opening of the image forming apparatus main body is hardly visible by a user and the dropped toners do not give an unsatisfying impression to the user when the toner container is replaced with a new one.

To achieve one or more of these and other advantages, according to one aspect of the present invention, there is provided a toner container having a cylindrical shape which is detachably attached to an image forming apparatus main body of an image forming apparatus. The toner container includes a toner outlet formed at a circumferential surface of the toner container for discharging toners contained in the toner container, a shutter member formed at the circumferential surface of the toner container for opening or closing the toner outlet together with a rotational operation of the toner container in a state where the toner container is attached to the image forming apparatus main body, and a guiding member formed at a part surrounding the toner outlet configured to protrude from the circumferential surface of the toner container for guiding an opening or closing operation of the shutter member in a circumferential direction of the toner container. The image forming apparatus main body includes a toner supplying opening configured to be connected to the toner outlet, and a main body side shutter for opening or closing the toner supplying opening. When the shutter member of the toner container is opened, an end surface of the guiding member pushes the main body side shutter together with the opening operation of the shutter member and the toner outlet is opened, and the toner outlet is connected to the toner supplying opening.

EFFECT OF INVENTION

According to an embodiment of the present invention, when a shutter member opens a toner outlet, an end surface of a guiding member pushes a main body side shutter, and a toner supplying opening is opened. With this, the toner supplying opening is connected to the toner outlet. Therefore, even if toners are adhered onto a surrounding part of the toner supplying opening, the shutter member is surely engaged with the main body side shutter, and the shutter is surely opened by interfacing with the opening operation of the shutter member. With this, an abnormal connection of the toner outlet with the toner supplying opening can be prevented. In addition, since toners dropped from the toner container to a part surrounding the toner supplying opening are hidden by the main body side shutter, stains caused by the dropped toners is hardly visible by a user when the toner container is replaced with a new one. Thus, an unsatisfying impression is not given to the user.

BRIEF DESCRIPTION OF DRAWINGS

Features and advantages of the present invention will become more apparent from the following detailed description when read in conjunction with the accompanying drawings, in which.

MODE(S) FOR CARRYING OUT THE INVENTION

Figure 1:
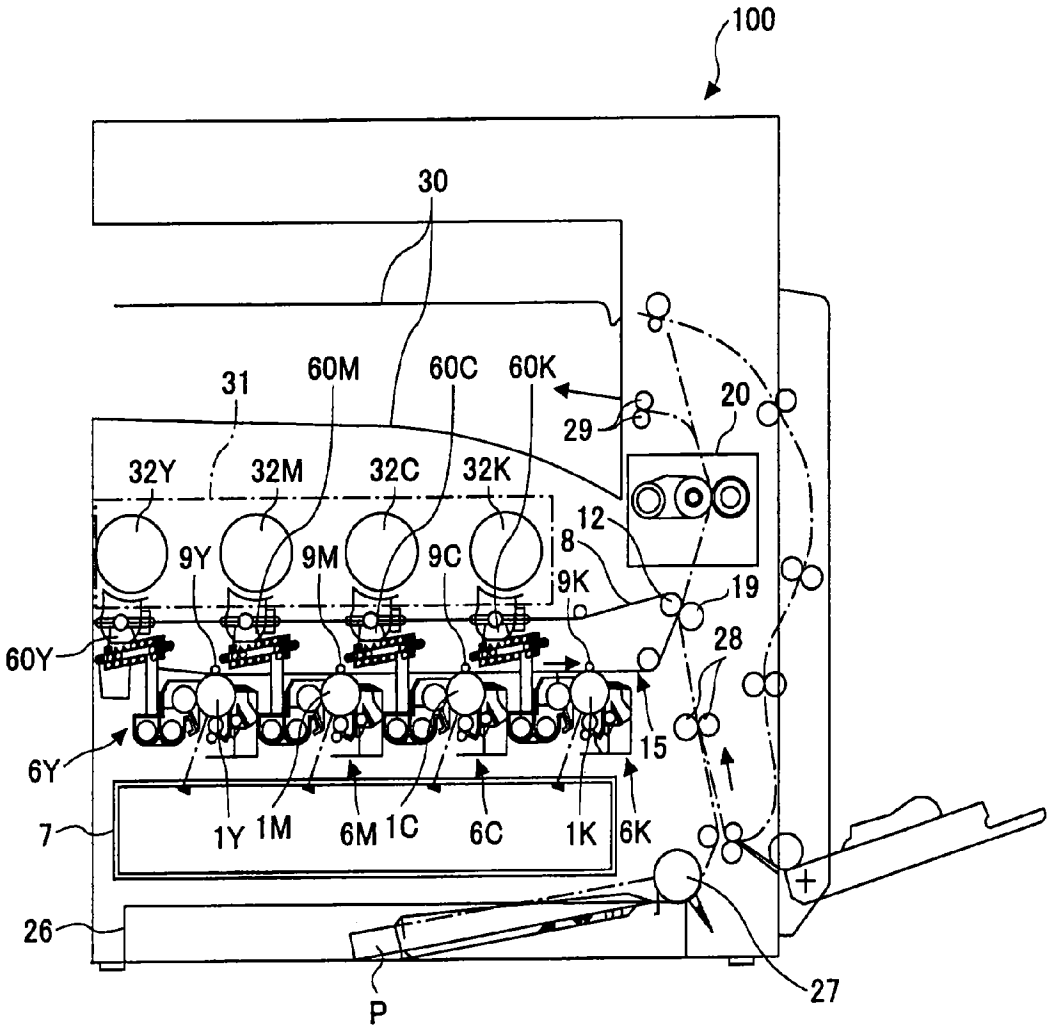
FIG. 1 is a schematic diagram showing a part of a structure of an image forming apparatus main body of an image forming apparatus according to a first embodiment of the present invention.

Referring to the drawings, embodiments of the present invention are described in detail.

First Embodiment

Referring to FIGS. 1 through 35, a first embodiment of the present invention is described in detail.

First, a structure and operations of an image forming apparatus are described.

FIG. 1 is a schematic diagram showing a part of a structure of an image forming apparatus main body 100 of an image forming apparatus according to the first embodiment of the present invention.

As shown in FIG. 1, in a toner container storing section 31 at an upper part of the image forming apparatus main body 100, four toner containers 32Y, 32M, 32C, and 32K corresponding to four colors yellow, magenta, cyan, and black are detachably attached to the toner container storing section 31.

An intermediate transfer unit 15 is provided under the toner container storing section 31. The intermediate transfer unit 15 includes an intermediate transfer belt 8. Image forming sections 6Y, 6M, 6C, and 6K corresponding to the four colors yellow, magenta, cyan, and black are positioned to face the intermediate transfer belt 8.

Toner supplying devices 60Y, 60M, 60C, and 60K are provided under the corresponding toner containers 32Y, 32M, 32C, and 32K. Toners contained in the toner containers 32Y, 32M, 32C, and 32K are supplied to corresponding developing devices in the image forming sections 6Y, 6M, 6C, and 6K by the corresponding toner supplying devices 60Y, 60M, 60C, and 60K.

Some elements in FIG. 1 which are not described above are described below.

In the following, since elements for processing the corresponding colors yellow, magenta, cyan and black are substantially identical to each other, in some cases, elements for the yellow color having suffix Y are described as representative.

Figure 2:
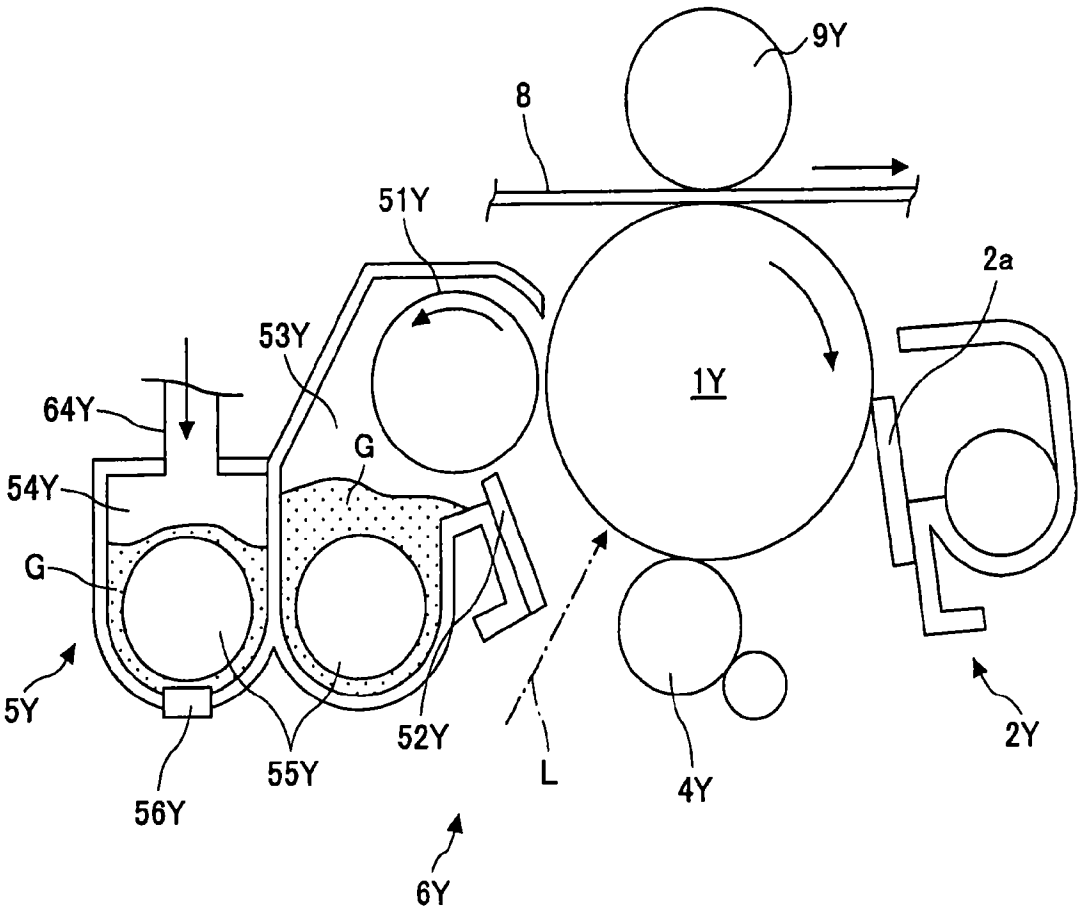
FIG. 2 is a schematic diagram showing a part of a structure of the image forming apparatus main body including an image forming section shown in FIG. 1.

FIG. 2 is a schematic diagram showing a part of a structure of the image forming apparatus main body 100 including the image forming section 6Y shown in FIG. 1.

As shown in FIG. 2, the image forming section 6Y corresponding to the yellow color includes a photoconductor drum 1Y, a charging section 4Y facing the photoconductor drum 1Y, a developing device 5Y (developing section), a cleaning section 2Y, and a discharging section (not shown). Image forming processes (a charging process, an exposing process, a developing process, a transferring process, and a cleaning process) are performed on the photoconductor drum 1Y, and a yellow image is formed on the photoconductor drum 1Y.

Each of the image forming sections 6M, 6C, and 6K has a structure substantially identical to the structure of the image forming section 6Y and forms a corresponding color image. Therefore, in the following, the image forming section 6Y is mainly described while omitting the descriptions of the image forming sections 6M, 6C, and 6K.

In FIG. 2, the photoconductor drum 1Y is rotated clockwise by a driving motor (not shown). Then, the surface of the photoconductor drum 1Y is uniformly charged by the charging section 4Y (the charging process).

The surface of the photoconductor drum 1Y reaches a position where laser beams L are radiated from an exposing device 7 (see FIG. 1) and an electrostatic latent image corresponding to yellow is formed at the position by being exposed by the laser beams (the exposing process).

Then the surface of the photoconductor drum 1Y on which the electrostatic latent image has been formed reaches a position facing the developing device 5Y, the electrostatic latent image is developed at the position, and a yellow toner image is formed (the developing process).

Then the surface of the photoconductor drum 1Y on which the toner image has been formed reaches a position facing the intermediate transfer belt 8 and a primary transfer bias roller 9Y, and the toner image on the photoconductor drum 1Y is transferred onto the intermediate transfer belt 8 at the position (a primary transferring process). At this time, a small amount of toners which have not been transferred onto the intermediate transfer belt 8 remain on the photoconductor drum 1Y.

Then the surface of the photoconductor drum 1Y reaches a position facing the cleaning section 2Y and the toners remaining on the surface of the photoconductor drum 1Y are mechanically removed by a cleaning blade 2*a* (the cleaning process).

Finally, the surface of the photoconductor drum 1Y reaches a position facing the discharging section and electric charges remaining on the surface of the photoconductor drum 1Y are discharged.

By the above processes, the image forming process on the photoconductor drum 1Y is completed.

The above image forming process is performed in the image forming sections 6M, 6C, and 6K, similar to in the image forming section 6Y. That is, the laser beams L corresponding to image information are radiated onto the corresponding photoconductor drums 1M, 1C, and 1K from the exposing device 7 positioned under the image forming sections 6M, 6C, and 6K. Specifically, the exposing device 7 causes a light source to emit the laser beams L and radiates the laser beams L onto the corresponding photoconductor drums 1M, 1C, and 1K via plural optical elements while the laser beams L are scanned by a rotating polygon mirror.

After the developing process, the toner images formed on the corresponding photoconductor drums 1Y, 1M, 1C, and 1K are transferred onto the intermediate transfer belt 8 by being superposed. With this, a color image is formed on the intermediate transfer belt 8.

Returning to FIG. 1, the intermediate transfer unit 15 includes the intermediate transfer belt 8, four primary transfer bias rollers 9Y, 9M, 9C, and 9K, a secondary transfer backup roller 12, plural tension rollers (not shown), and an intermediate transfer cleaning section (not shown). The intermediate transfer belt 8 is supported by plural rollers and is endlessly rotated in the arrow direction by the secondary transfer backup roller 12.

Primary transfer nips are formed by sandwiching the intermediate transfer belt 8 between the four primary transfer bias rollers 9Y, 9M, 9C, and 9K and the four photoconductor drums 1Y, 1M, 1C, and 1K. A transfer bias voltage whose polarity is inverted relative to the polarity of the toners is applied to the four primary transfer bias rollers 9Y, 9M, 9C, and 9K.

The intermediate transfer belt 8 sequentially passes through the primary transfer nips of the primary transfer bias rollers 9Y, 9M, 9C, and 9K by being moved in the arrow direction. With this, the toner images on the corresponding photoconductor drums 1Y, 1M, 1C, and 1K are primarily transferred onto the intermediate transfer belt 8 by being superposed.

The intermediate transfer belt 8 onto which the toner images have been transferred by being superposed reaches a position facing a secondary transfer roller 19. A secondary transfer nip is formed at the position where the intermediate transfer belt 8 is sandwiched between the secondary transfer backup roller 12 and the secondary transfer roller 19. Then, the four-color toner image formed on the intermediate transfer belt 8 is transferred onto a recording medium P (for example, paper) carried to the position of the secondary nip (a secondary transferring process). At this time, toners which have not been transferred onto the recording medium P remain on the intermediate transfer belt 8.

Then the intermediate transfer belt 8 reaches a position facing the intermediate transfer cleaning section and the toners remaining on the intermediate transfer belt 8 are removed at the position.

With this, the transfer process which is performed on the intermediate transfer belt 8 is completed.

The recording medium P is carried to the position of the secondary nip from a paper feeding section 26 at a lower part of the image forming apparatus main body 100 via a paper feeding roller 27, a pair of registration rollers 28, and so on.

Specifically, the plural recording media P (many pieces of paper) are stored in the paper feeding section 26 by being stacked. When the paper feeding roller 27 is rotated counterclockwise, a top recording medium P is carried to a position between the pair of registration rollers 28.

The recording medium P carried to the pair of registration rollers 28 is temporarily stopped at a roller nip position of the pair of registration rollers 28 whose rotation is stopped. Then the pair of registration rollers 28 is rotated again by matching the timing of the color image on the intermediate transfer belt 8, and the recording medium P is carried to the secondary transfer nip. With this, the color image is transferred onto the recording medium P.

The recording medium P onto which the color image has been transferred at the position of the secondary transfer nip is carried to a fixing section 20 and the color image on the recording medium P is fixed by heat and pressure from a corresponding fixing belt and a pressure applying roller of the fixing section 20.

The recording medium P on which the color image has been formed is output to a stacking section 30 via a pair of paper outputting rollers 29. When plural recording media P are output, the output plural recording media P are sequentially stacked on the stacking section 30.

By the above processes, the image forming process in the image forming apparatus main body 100 is completed.

Next, returning to FIG. 2, a structure and operations of the developing device 5Y in the image forming section 6Y are described in detail.

The developing device 5Y includes a developing roller 51Y facing the photoconductor drum 1Y, a doctor blade 52Y facing the developing roller 51Y, developer containers 53Y and 54Y, two carrying screws 55Y in the corresponding developer containers 53Y and 54Y, and a concentration detecting sensor 56Y for detecting a toner concentration in a developer G.

The developing roller 51Y includes a magnet (not shown) secured inside the developing roller 51Y and a sleeve (not shown) which is rotated around the magnet. The developer G (two-component developer) formed of carrier particles (toner carrier) and toners is contained in the developer containers 53Y and 54Y. The developer container 54Y is connected to a toner dropping route 64Y via an opening formed at an upper side of the developer container 54Y.

Next, operations of the developing device 5Y are described.

The sleeve of the developing roller 51Y is rotated in the arrow direction shown in FIG. 2. The developer G carried on the developing roller 51Y by a magnetic field generated by the magnet is moved on the developing roller 51Y while the sleeve is rotated.

The toner concentration of the developer G in the developing device 5Y is adjusted to be a value within a predetermined range. Specifically, toners contained in the toner container 32Y (see FIG. 1) are supplied to the developer container 54Y via the toner supplying device 60Y (see FIG. 1) corresponding to a consumed amount of toners in the developing device 5Y. The toner supplying device 60Y is described below in detail.

The toners supplied to the developer container 54Y are mixed with the developer G in the developer container 54Y, and the developer G is circulated in the two developer containers 53Y and 54Y while the developer G is stirred by the carrying screws 55Y. The developer G is moved in the direction perpendicular to the plane of the paper of FIG. 2.

The toners in the developer G are adhered to carrier particles by a friction charge with the carrier particles and are carried on the developing roller 51Y with the carrier particles by a magnetic force formed on the developing roller 51Y.

The developer G carried on the developing roller 51Y reaches the doctor blade 52Y by being carried in the arrow direction. The amount of the developer G on the developing roller 51Y is adjusted to be a suitable value by the doctor blade 52Y and the developer G whose amount is adjusted is carried to a position facing the photoconductor drum 1Y. The position is a developing region. The toners in the developer G are adhered onto an electrostatic latent image formed on the photoconductor drum 1Y by an electric field generated in the developing region. The developer G remaining on the developing roller 51Y reaches an upper part in the developer container 53Y by the rotation of the sleeve and the remaining developer G is dropped from the developing roller 51Y.

Next, referring to FIGS. 3 through 18, the toner supplying devices 60Y, 60M, 60C, and 60K are described.

Figure 3:
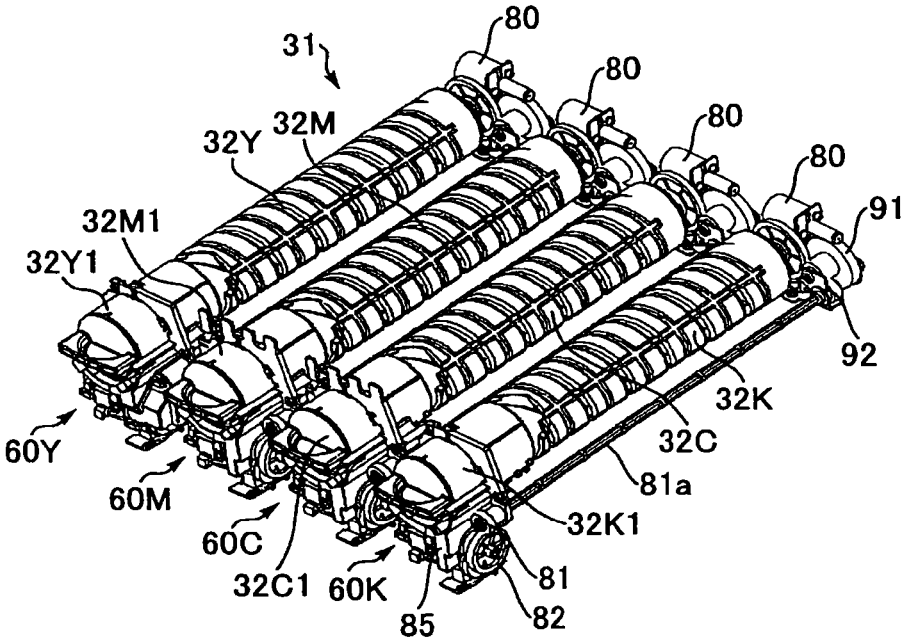
FIG. 3 is a perspective view of a part of the structure of the image forming apparatus main body including a toner container storing section shown in FIG. 1.
Figure 4:
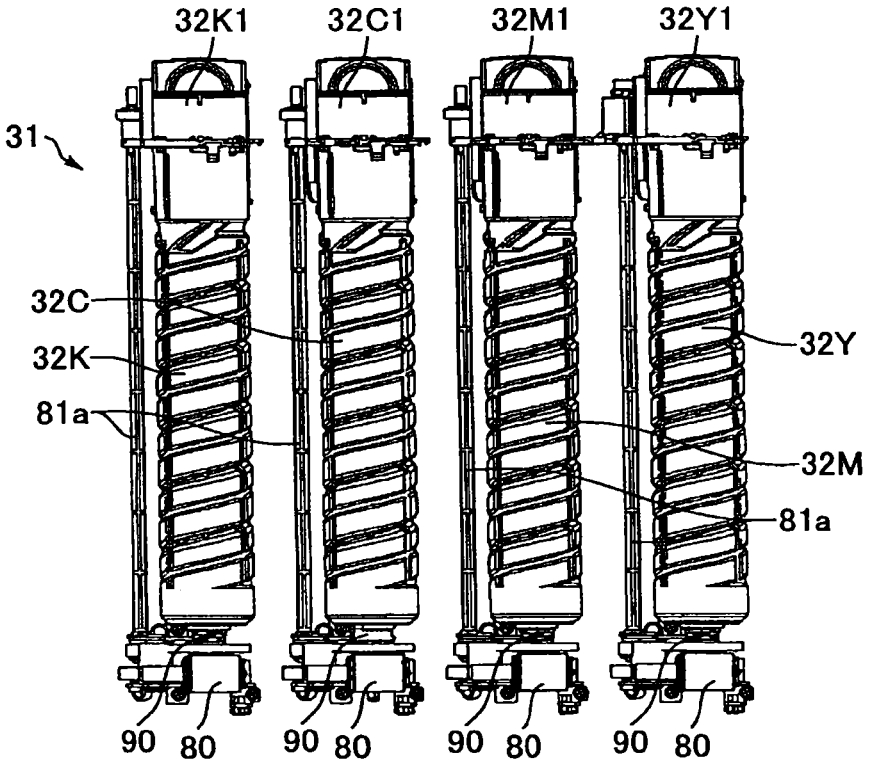
FIG. 4 is a top view of a part of the structure of the image forming apparatus main body including a toner container storing section shown in FIG. 1.
Figure 5:
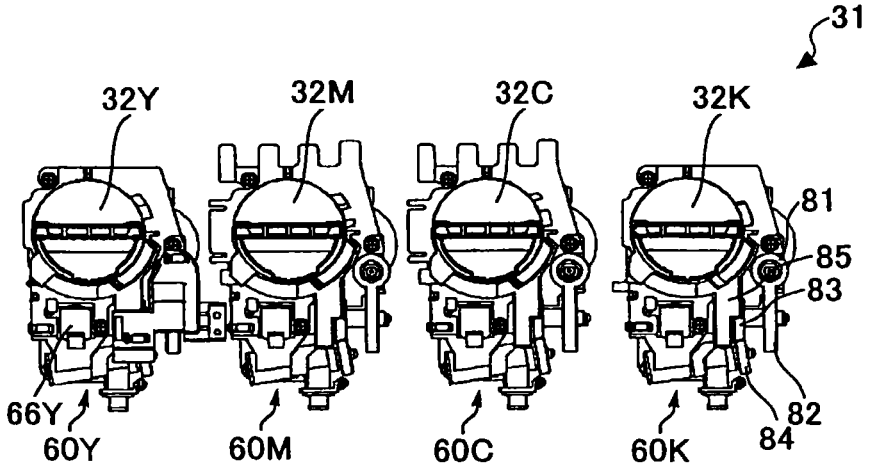
FIG. 5 is a front view of a part of the structure of the image forming apparatus main body including the toner container storing section shown in FIG. 1.

FIG. 3 is a perspective view of a part of the structure of the image forming apparatus main body 100 including the toner container storing section 31 shown in FIG. 1. FIG. 4 is a top view of a part of the structure of the image forming apparatus main body 100 including the toner container storing section 31 shown in FIG. 1. FIG. 5 is a front view of a part of the structure of the image forming apparatus main body 100 including the toner container storing section 31 shown in FIG. 1.

In FIGS. 3 through 5, the toners contained in the corresponding toner containers 32Y, 32M, 32C, and 32K in the toner container storing section 31 are suitably supplied to the corresponding developing devices by the corresponding toner supplying devices 60Y, 60M, 60C, and 60K based on the consumed amounts of the corresponding toners.

The structure of each of the toner supplying devices 60Y, 60M, 60C, and 60K is substantially equal, and the structure of each of the toner containers 32Y, 32M, 32C, and 32K is substantially equal. Therefore, the toner supplying device 60Y and the toner container 32Y are described as representative.

In FIGS. 3 through 5, when the toner container 32Y is installed in the toner container storing section 31, a shutter member of the toner container 32Y is moved in synchronization with the installation of the toner container 32Y, and a toner outlet W (see FIG. 12) of the toner container 32Y is opened. In addition, a shutter 89 (main body side shutter) (see FIG. 18) of the image forming apparatus main body 100 is moved and a toner supplying opening 60Ya (see FIG. 18) of the toner supplying device 60Y is opened. Consequently, the toner outlet W is connected to the toner supplying opening 60Ya.

With this, the toners contained in the toner container 32Y are discharged from the toner outlet W and are stored in a toner tank of the toner supplying device 60Y.

Figure 12:
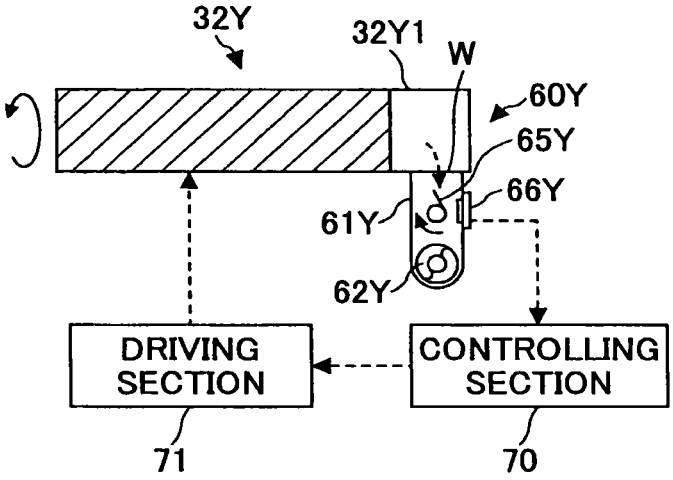
FIG. 12 is a schematic diagram showing a state where the toner container is connected to the toner supplying device.

FIG. 12 is a schematic diagram showing a state where the toner container 32Y is connected to the toner supplying device 60.

In FIG. 12, the toner container 32Y is an approximately cylinder-shaped toner bottle, and includes a spiral protrusion on the internal circumferential surface of the toner container 32Y. When the spiral protrusion is viewed from the outside, a spiral groove is viewed. When the toner container 32Y is rotated in the arrow direction by a driving section 71, the spiral protrusion discharges the toners from the toner outlet W. The driving section 71 includes a driving motor 80, a driving coupling member 90, and a gear 91 (see FIG. 6).

That is, when the toner container 32Y is suitably rotated by the driving section 71, the toners are suitably supplied to a toner tank 61Y of the toner supplying device 60. When the service life of each of the toner containers 32Y, 32M, 32C, and 32K has passed; that is, when almost all toners in the toner container 32Y have been consumed, an old one is replaced with a new one.

In FIG. 12, the toner supplying device 60Y includes the toner tank 61Y, a toner carrying screw 62Y, a toner carrying tube 63Y (see FIG. 13), a toner dropping route 64Y (see FIG. 13), a toner stirring member 65Y, and a toner end sensor 66Y (detecting unit). The toner carrying screw 62Y and the toner carrying tube 63Y form a toner carrying section (see FIG. 13).

Figure 6:
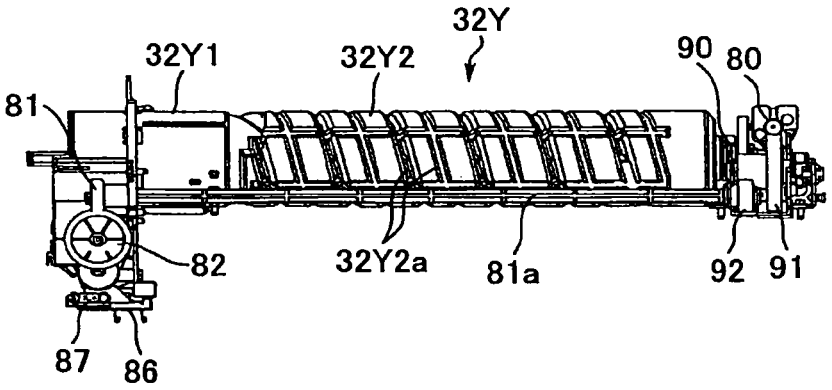
FIG. 6 is a side view of a part of the structure of the image forming apparatus main body including the toner container storing section shown in FIG. 1.

FIG. 6 is a side view of a part of the structure of the image forming apparatus main body 100 including the toner container storing section 31 shown in FIG. 1.

Figure 18:
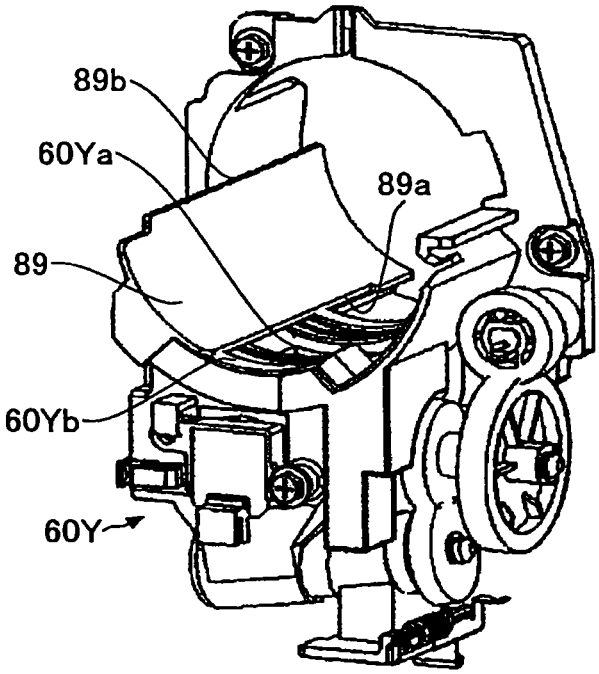
FIG. 18 is a perspective view of the toner supplying device when a shutter is attached to a position of the toner supplying opening.

In FIG. 6, the driving section 71 (see FIG. 12) includes the driving motor 80, the driving coupling member 90, and a gear train formed of gears 81 through 84 (see FIGS. 14), 91, and 92, a driving force transmitting shaft 81*a*, a dropping part shutter 86, a supporting member (not shown), an antenna substrate 120 (see FIG. 10), a toner receiving section 85 (see FIG. 3), and the shutter 89 (see FIG. 18).

In FIGS. 3 through 6, the driving coupling member 90 for engaging with an engaging section 32Y2*b* (see FIG. 20) formed at the bottom of the toner container 32Y is positioned at the back side of the toner supplying device 60Y (at the back side of the toner container attaching direction). A driving force of the driving motor 80 is transmitted to the driving coupling member 90 via the gear (double gear), and a container main body 32Y2 of the toner container 32Y is rotated in a predetermined direction by the driving coupling member 90.

The gear 92 which engages with the gear 91 transmits the driving force to the gear 81 positioned at the front side of the toner supplying device 60Y via the driving force transmitting shaft 81*a*. The driving force transmitted to the gear 81 rotates the toner carrying screw 62Y and the toner stirring member 65Y via the gear train formed of the gears 81 through 84. The structure of the toner supplying device 60Y at the front side where the toner carrying screw 62Y and the toner stirring member 65Y are positioned is described below in detail by referring to FIGS. 12 through 18.

Figure 7:
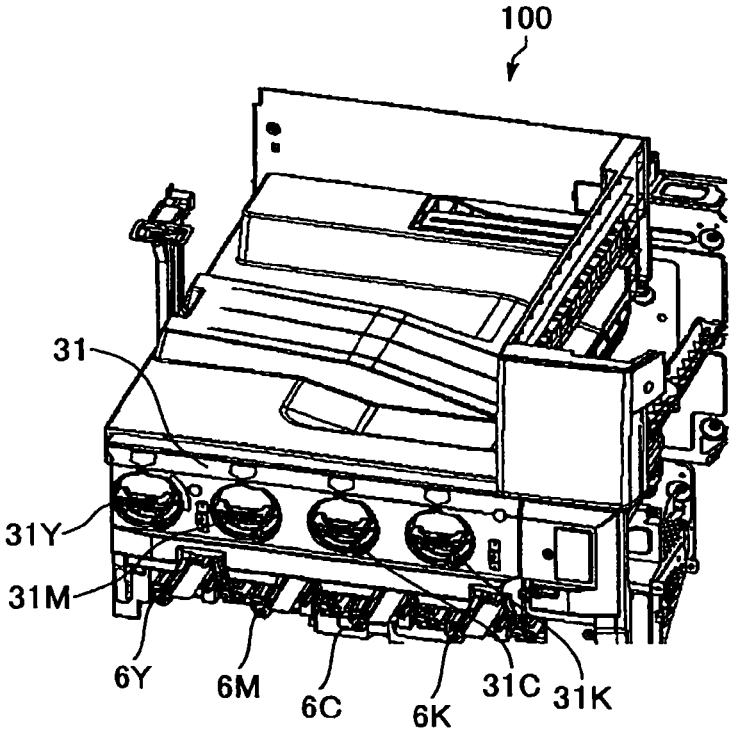
FIG. 7 is a perspective view of a part of the image forming apparatus main body including the toner container storing section shown in FIG. 1.

FIG. 7 is a perspective view of a part of the image forming apparatus main body 100 including the toner container storing section 31.

Figure 8:
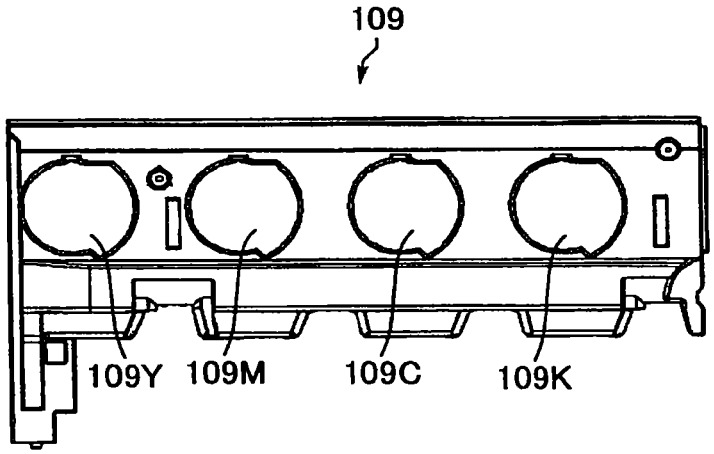
FIG. 8 is a front view of a part of the image forming apparatus main body when a main body cover is opened.

As shown in FIG. 7, when a main body cover (not shown) positioned at the front side of the image forming apparatus main body 100 is opened, the toner container storing section 31 is exposed. FIG. 8 is a front view of a part of the image forming apparatus main body 100 when the main body cover is opened. As shown in FIG. 8, when the main body cover is opened, an inner cover 109 is exposed in which four inserting openings 109Y, 109M, 109C, and 109K are formed. The toner containers 32Y, 32M, 32C, and 32K are inserted into the corresponding inserting openings 109Y, 109M, 109C, and 109K. That is, attaching and detaching operations of the toner containers 32Y, 32M, 32C, and 32K are performed from the front side of the image forming apparatus main body 100 in the long length direction of the toner containers 32Y, 32M, 32C, and 32K.

Figure 9:
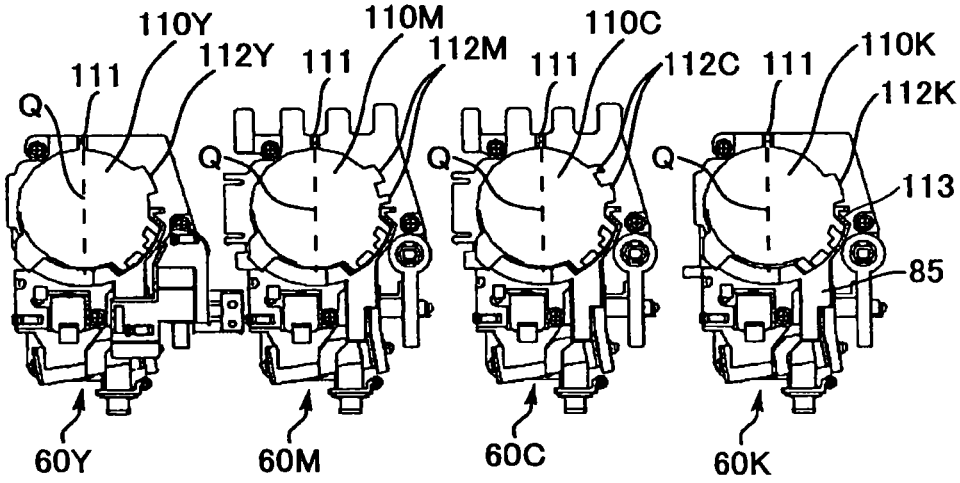
FIG. 9 is a front view of inserting openings into which the corresponding toner supplying devices shown in FIG. 1 are inserted.

FIG. 9 is a front view of inserting openings into which the corresponding toner supplying devices 60Y, 60M, 60C, and 60K are inserted. In FIG. 8, the shapes of the inserting openings 109Y, 109M, 109C, and 109K are the same. However, in FIG. 9, the shapes of inserting openings 110Y, 110M, 110C, and 110K into which the corresponding toner supplying devices 60Y, 60M, 60C, and 60K are inserted are different from each other.

Specifically, as shown in FIG. 9, in each of the inserting openings 110Y, 110M, 1100, and 110K, a first guide groove 111; into which corresponding guide ribs 32Y1*f*, 32M1*f*, 32C1*f*, and 32K1*f* (see FIGS. 25 through 28) formed at corresponding cap sections of the toner containers 32Y, 32M, 32C, and 32K are engaged; is formed.

In addition, in the inserting openings 110Y, 110M, 110C, and 110K, second guide grooves 112Y, 112M, 112C, and 112K; into which corresponding protrusion members 32Y1*d* and 32Y1*e*, 32M1*d* and 32M1*e*, 32C1*d* and 32C1*e*, and 32K1*d* and 32K1*e* (see FIGS. 25 through 28) formed at the corresponding cap sections of the toner containers 32Y, 32M, 32C, and 32K are engaged; are formed. That is, the shapes of the second guide grooves 112Y, 112M, 112C, and 112K are different from each other, and prevent the toner supplying devices 60Y, 60M, 60C, and 60K from being inserted into a wrong position.

The second guide grooves 112Y, 112M, 112C, and 112K are positioned at the same sides (in FIG. 9, at the right sides) in the corresponding inserting openings 110Y, 110M, 110C, and 110K, when a virtual vertical line Q passing through the center of the first guide grove 111 is determined to be a reference. That is, the protrusion members 32Y1*d* and 32Y1*e*, 32M1*d* and 32M1*e*, 32C1*d* and 32C1*e*, and 32K1*d* and 32Kle which are different from each other are positioned near the corresponding guide ribs 32Y1*f*, 32M1*f*, 32C1*f*, and 32K1*f*.

Since the second guide grooves 112Y, 112M, 112C, and 112K in the corresponding inserting openings 110Y, 110M, 110C, and 110K are positioned at the right sides in FIG. 9; the distance between the adjacent two of the inserting openings 110Y, 110M, 110C, and 110K can be relatively small.

In FIG. 9, in each of the inserting openings 110Y, 110M, 110C, and 110K into which the corresponding toner supplying devices 60Y, 60M, 60C, and 60*k* are inserted; a stopped part 113 having a groove shape is formed. As a representative, a stopping part 32Y1*a*3 of a shutter member 32Y1*a* (see FIGS. 40, 42, and 43) of the toner container 32Y is engaged into the stopped part 113.

With this, when the toner container 32Y is attached to or detached from the image forming apparatus main body 100, the movement of the toner container 32Y in the short length direction (the lateral direction of the paper of FIG. 9) of the toner container 32Y can be prevented. In particular, when a user rotates a cap section 32Y1 by grasping a handle part 32Y1*b* (see FIGS. 40 and 43) in a state where the toner container 32Y has been attached to the image forming apparatus main body 100, even if the a rotational force of the user is biased to one side, since the stopping part 32Y1*a*3 of the toner container 32Y has been engaged into the stopped part 113 of the toner supplying device 60Y, the toner container 32Y can be normally attached to the toner supplying device 60Y.

Figure 10:
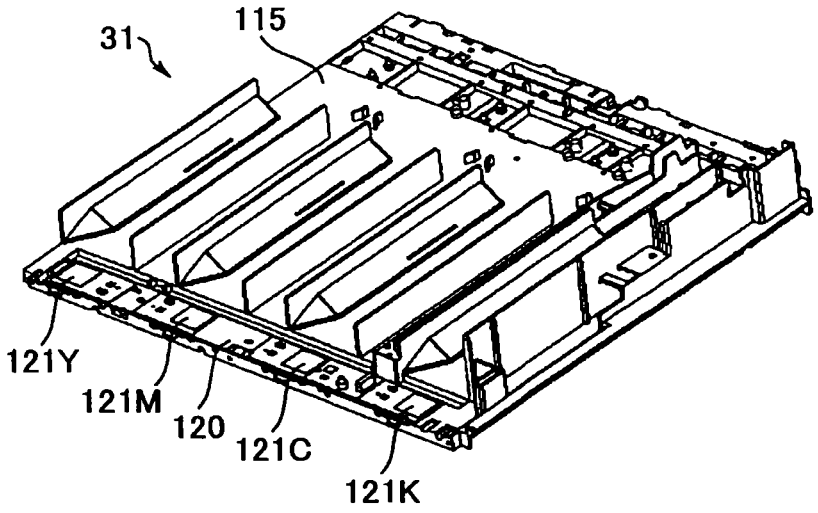
FIG. 10 is a perspective view of the toner container storing section shown in FIG. 1.
Figure 11A:
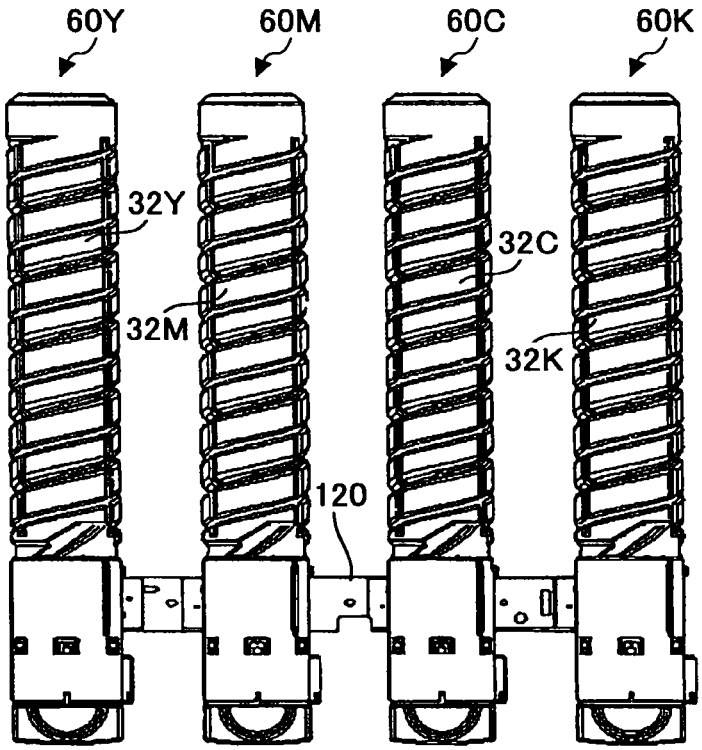
FIG. 11A is a plan view of the toner supplying devices shown in FIG. 1 to which the corresponding toner containers are attached.
Figure 11B:
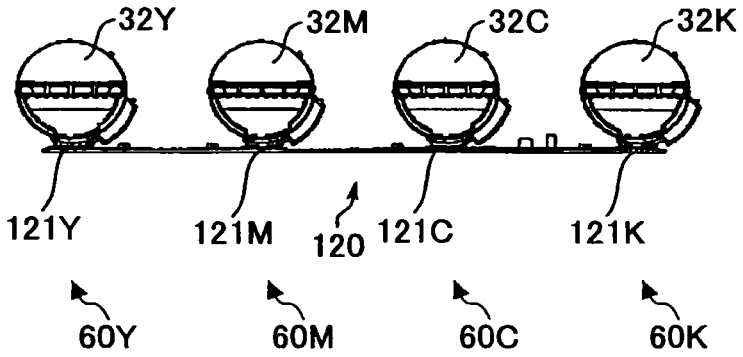
FIG. 11B is a front view of the toner supplying devices shown in FIG. 1 to which the corresponding toner containers are attached.

FIG. 10 is a perspective view of the toner container storing section 31. FIG. 11A is a plan view of the toner supplying devices 60Y, 60M, 60*c* and 60K to which the corresponding toner containers 32Y, 32M, 32C, and 32K are attached. FIG. 11B is a front view of the toner supplying devices 60Y, 60M, 60*c* and 60K to which the corresponding toner containers 32Y, 32M, 32C, and 32K are attached.

In the first embodiment of the present invention, the toner containers 32Y, 32M, 32C, and 32K are detachably attached to the corresponding toner supplying devices 60Y, 60M, 60C, and 60K. As shown in FIG. 10, the antenna substrate 120 is positioned on a supporting part 115 of the toner container storing section 31.

Specifically, four antennas 121Y, 121M, 121C, and 121K are positioned on a surface of the antenna substrate 120. The four antennas 121Y, 121M, 121C, and 121K communicate with corresponding electronic substrates 32Y1*c*, 32M1*c*, 32C1*c*, and 32K1*c* (see FIGS. 25 through 28) positioned on the circumferential surfaces of the corresponding toner containers 32Y, 32M, 32C, and 32K. The antenna substrate 120 is under the toner containers 32Y, 32M, 32C, and 32K positioned on the supporting part 115 of the toner container storing section 31.

Information is transmitted and received between the electronic substrates 32Y1*c*, 32M1*c*, 32C1*c*, and 32K1*c* of the toner containers 32Y, 32M, 32C, and 32K, and the antennas 121Y, 121M, 121C, and 121K of the antenna substrate 120 positioned in the image forming main body 100. The information to be communicated with each other is, for example, the production serial number of the toner container, the recycled number of the toner container, the kind of toners, the production lot number of toners, the production date of toners, the manufacturer of toners, the amount of toners in the toner container, the color of toners, and a usage history of the image forming apparatus main body 100.

In the first embodiment of the present invention, since the electronic substrates 32Y1*c*, 32M1*c*, 32C1*c*, and 32K1*c* face the corresponding antennas 121Y, 121M, 121C, and 121K; the communications between the electronic substrates 32Y1*c*, 32M1*c*, 32C1*c*, and 32K1*c* and the corresponding antennas 121Y, 121M, 121C, and 121K are performed in good conditions. In addition, since the antennas 121Y, 121M, 121C, and 121K are positioned under the supporting part 115 of the toner storing section 31, the toner supplying device 60Y, 60M, 60C, and 60K (the image forming apparatus main body 100) are not large sized in the long length direction. With this, cost of components to be used in the image forming apparatus main body 100 and manufacturing cost of the image forming apparatus main body 100 can be relatively low, and the installing capability of the image forming apparatus main body 100 in an office can be increased.

Figure 32:
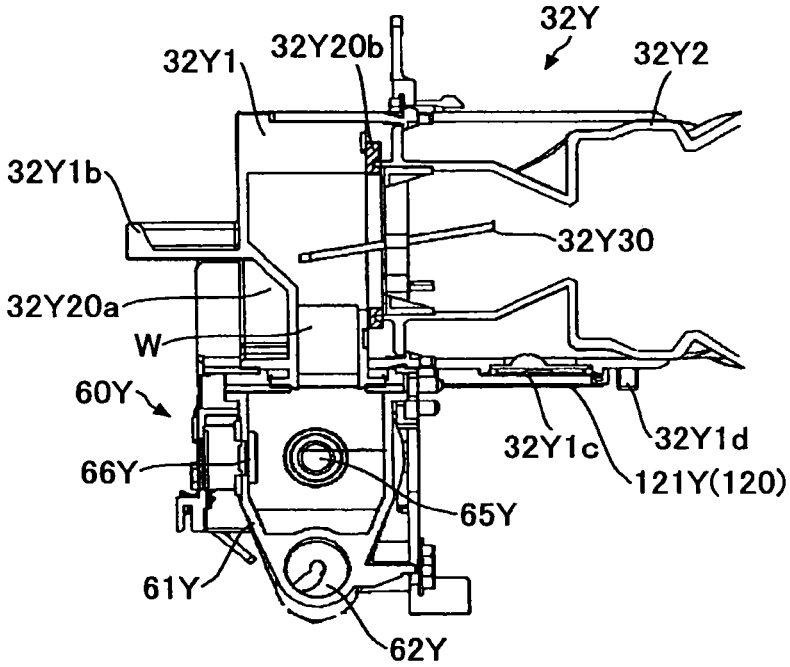
FIG. 32 is a schematic diagram showing the head part of the toner container attached to the toner supplying device.

FIG. 32 is a schematic diagram showing a head part of the toner container 32Y attached to the toner supplying device 60Y. As shown in FIG. 32, the antenna substrate 120 (the antenna 121Y) is positioned at the right side of the toner outlet W of the toner container 32Y. Even if toners are leaked from the toner outlet W, the toners are dropped to the left side of the image forming apparatus main body 100.

Specifically, when the engaging section 32Y2*b* (see FIG. 20) of the container main body 32Y2 is at a position where the engaging section 32Y2*b* engages with the driving coupling member 90 (see FIG. 6), the toner outlet W is separated from the antenna substrate 120 and the electronic substrate 32Y1*c* facing the antenna substrate 120 by the inserting opening 110Y (see FIG. 9). Therefore, the toners are hardly dropped on the antenna substrate 120 directly. Consequently, the decrease of the communication sensitivity due to the drop of the toners at a position between the electronic substrate 32Y1*c* and the antenna 121Y can be prevented.

Since it is preferable that the electronic substrate 32Y1*c* of the toner container 32Y is positioned to face the antenna substrate 120, the electronic substrate 32Y1*c* is positioned at the back side relative to the position of the toner outlet W.

That is, the electronic substrate 32Y1*c* is positioned at the back side of the toner supplying opening 60Ya of the image forming apparatus main body 100. Therefore, when the toner container 32Y is attached to or detached from the toner supplying device 60Y, the electronic substrate 32Y1*c* passes through an adjacent position over the toner supplying opening 60Ya. Consequently, there is a risk that the electronic substrate 32Y1*c* is contaminated by a small amount of a powder smoke of the toners. In order to solve the above problem, the shutter 89 (the main body side shutter) closes the toner supplying opening 60Ya.

Referring to FIGS. 12 through 18, a structure and operations of the toner supplying device 60Y are described in detail.

Figure 13:
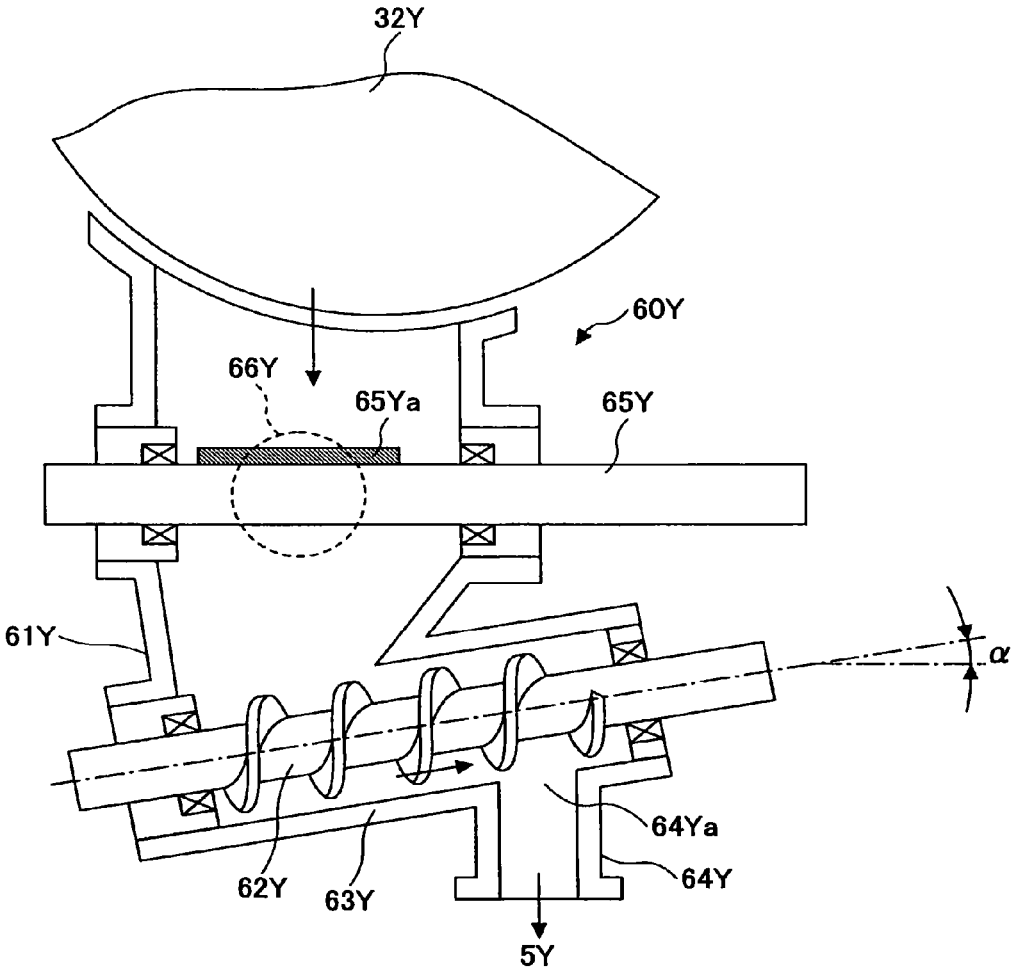
FIG. 13 is a cut-away side view of the toner supplying device.
Figure 14:
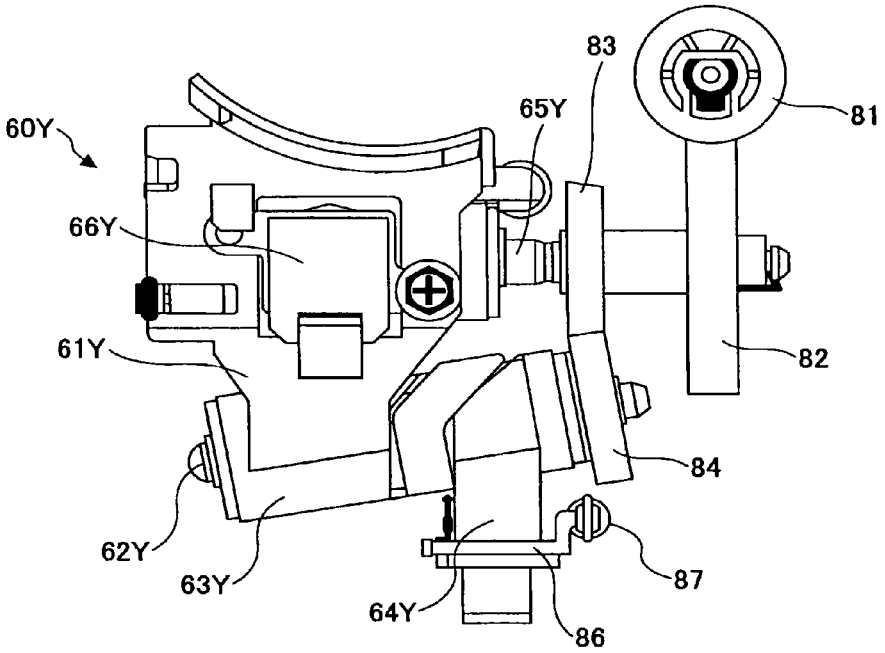
FIG. 14 is an external side view of the toner supplying device.
Figure 15:
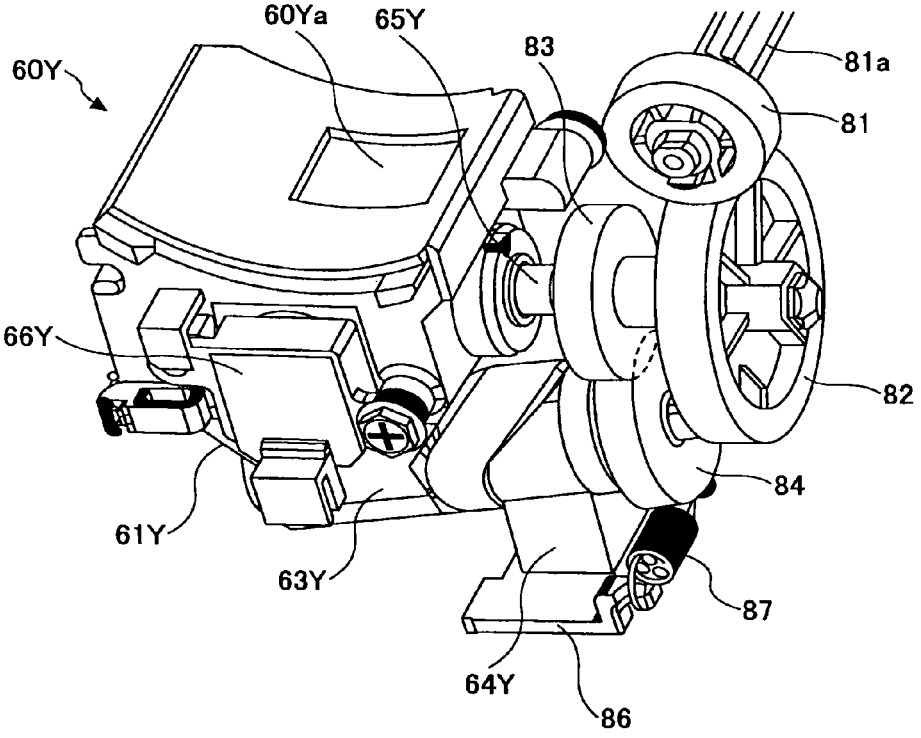
FIG. 15 is a perspective view of the toner supplying device.
Figure 16:
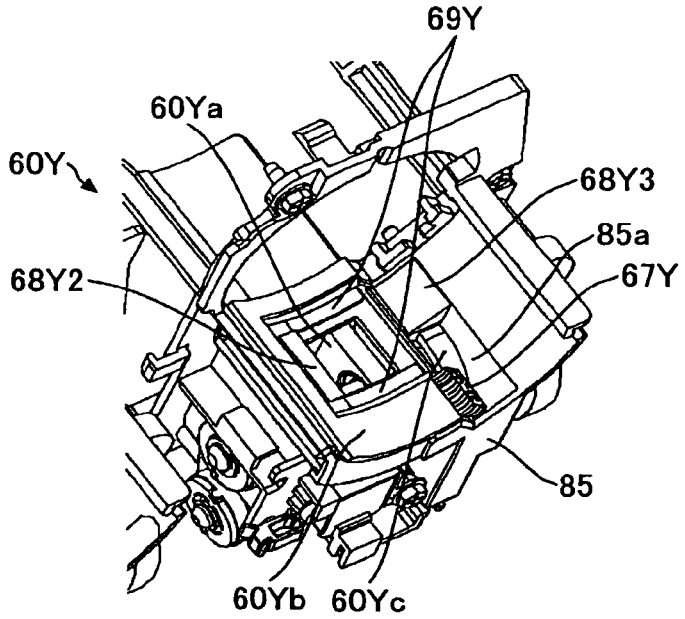
FIG. 16 is a perspective view of the toner supplying device when the toner supplying opening is opened.
Figure 17:
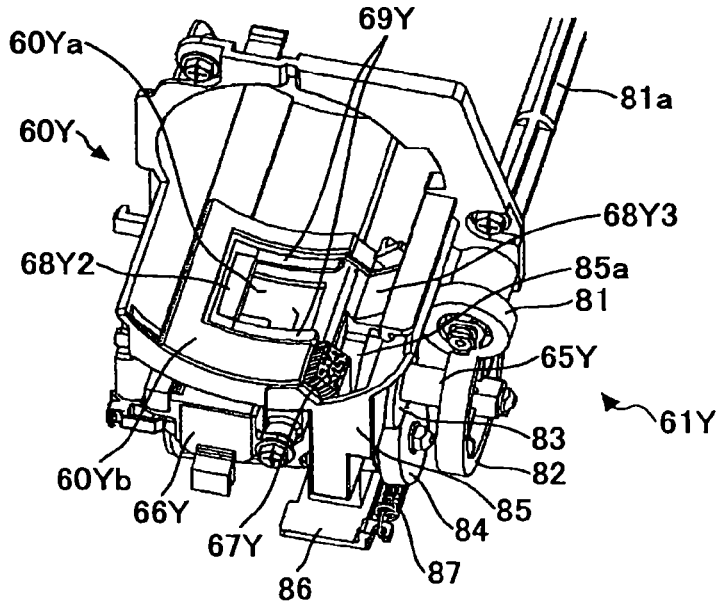
FIG. 17 is another perspective view of the toner supplying device when the toner supplying opening is opened.

FIG. 13 is a cut-away side view of the toner supplying device 60Y. FIG. 14 is an external side view of the toner supplying device 60Y. FIG. 15 is a perspective view of the toner supplying device 60Y. FIG. 16 is a perspective view of the toner supplying device 60Y when the toner supplying opening 60Ya is opened. FIG. 17 is another perspective view of the toner supplying device 60Y when the toner supplying opening 60Ya is opened. FIG. 18 is a perspective view of the toner supplying device 60Y when the shutter 89 is attached to a position of the toner supplying opening 60Ya.

In FIGS. 12 through 18, the toner supplying device 60Y includes the toner tank 61Y, the toner carrying screw 62Y, the toner carrying tube 63Y, the toner dropping route 64Y, the toner stirring member 65Y, the toner end sensor 66Y (detecting unit), the gear train formed of the gears 81 through 84, the toner receiving section 85, the shutter (main body side shutter). The shutter 89 is only shown in FIGS. 18 and 34, and is omitted in the other drawings.

The toner tank 61Y is under the toner outlet W of the cap section 32Y1 of the toner container 32Y and stores the toners discharged from the toner outlet W of the toner container 32Y via the toner supplying opening 60Ya. The bottom part of the toner tank 61Y is connected to an upstream side of a toner carrying section (the toner carrying screw 62Y and the toner carrying tube 63Y).

The toner end sensor 66Y is on a wall surface of the toner tank 61Y at a position having a predetermined height from the bottom surface of the toner tank 61Y. The toner end sensor 66Y detects a signal when the amount of the toners stored in the toner tank 61Y becomes a value less than a predetermined value. As the toner end sensor 66Y, a piezoelectric sensor can be used.

In FIG. 12, when the toner end sensor 66Y detects a signal that the amount of the toners stored in the toner tank 61Y has become a value less than a predetermined value, the signal is sent to a controlling section 70. The controlling section 70 controls the driving section 71 (the driving motor 80, the driving coupling member 90, and the gear 91 (see FIG. 6)) to rotate the toner container 32Y for a predetermined period so as to supply toners to the toner tank 61Y. When the toner end sensor 66Y continues to detect the signal even if the driving section 71 repeats rotating the toner tank 32Y, the controlling section 70 determines that no toners remain in the toner container 32Y. Then the controlling section 70 displays a message which instructs to replace the existing toner container 32Y with a new one on a displaying section (not shown) of the image forming apparatus main body 100.

The toner stirring member 65Y (rotating member) is at an inner center position of the toner tank 61Y near the toner end sensor 66Y for preventing the toners stored in the toner tank 61Y from being condensed. The toner stirring member 65Y includes a flexible member 65Ya, and rotates in the arrow direction clockwise as shown in FIG. 12, and stirs the toners in the toner tank 61Y. In addition, since the tip of the flexible member 65Ya of the toner stirring member 65Y slidably contacts the detecting surface of the toner end sensor 66Y with a rotational cycle of the toner stirring member 65Y, a decrease in the detecting accuracy due to adhering toners onto the detecting surface of the toner end sensor 66Y is prevented.

As shown in FIGS. 14 and 15, the gear 82 (a bevel gear) having a twisting angle of 45 degrees is attached to one end of the shaft of the toner stirring member 65Y, and a driving force is transmitted to the toner stirring member 65Y via the gear 81 (a bevel gear) having a twisting angle of 45 degrees engaged with the bevel gear 82.

In FIG. 13, the toner carrying screw 62Y and the toner carrying tube 63Y carry the toners stored in the toner tank 61Y in the obliquely upward direction (the arrow direction). Specifically, the toner carrying screw 62Y and the toner carrying tube 63Y linearly carry the toners from the bottom part (the lowest part) of the toner tank 61Y to a position above the developing device 5Y (a toner dropping opening 64Ya of the toner dropping route 64Y). The toners reaching the toner dropping opening 64Ya are supplied to the developer container 54Y (see FIG. 2) of the developing device 5 by the toner's own weight via the toner dropping route 64Y.

The toner carrying screw 62Y carries the toners by being rotated in a predetermined direction, and the toner carrying tube 63Y has an inner wall adjacent to the toner carrying screw 62Y. As described above, the toner carrying section includes the toner carrying screw 62Y and the toner carrying tube 63Y.

The toner carrying screw 62Y is a screw member in which a helicoid is spirally formed on a shaft and is rotatably supported in the toner carrying tube 63Y via bearings (not shown). As shown in FIGS. 14 and 15, the gear (skew gear) 84 is attached to one end of the toner carrying screw 62Y, and a driving force is transmitted to the toner carrying screw 62Y via the gear 83 (skew gear) attached to the shaft of the toner stirring member 65Y in which the gear 83 is engaged with the gear 84.

The upstream side of the toner carrying tube 63Y is connected to the toner tank 61Y and the downstream side of the toner carrying tube 63Y is connected to the toner dropping route 64Y via the toner dropping opening 64Ya (see FIG. 13). The toner carrying tube 63Y is a tube-shaped member formed of a resin material. The toner carrying screw 62Y (screw member) is rotatably supported in the toner carrying tube 63Y via a bearing. The gap between the external diameter of the toner carrying screw 62Y and the inner wall of the toner carrying tube 63Y is determined to be approximately 0.1 to 0.2 mm. With this, the toners are smoothly carried in the obliquely upward direction against the gravitational force by the toner carrying screw 62Y and the toner carrying tube 63Y.

As described above, in the first embodiment of the present invention, the toners stored in the toner tank 61Y are carried in the obliquely upward direction by the toner carrying screw 62Y and the toner carrying tube 63Y, and the carried toners are supplied to the developing device 5Y by the toner's own weight via the toner dropping route 64Y. With this, even if the rotation of the toner carrying screw 62Y is stopped when the supply of the toners to the developing device 5Y is stopped, the toners remaining in the toner carrying tube 63Y are hardly dropped into the developing device 5Y via the toner dropping route 64Y.

Specifically, the toners remaining at a position separated from the toner dropping opening 64Ya slide toward the toner tank 61Y along the oblique toner carrying tube 63Y or stay at the position. In addition, the toners remaining at a position near the toner dropping opening 64Ya in the toner carrying tube 63Y are not greatly dropped from the toner dropping opening 64Ya by the toner's own weight even if the apparatus is subjected to a great shock, and the toners slide toward the toner tank 61Y along the oblique toner carrying tube 63Y or stay at the position.

Therefore, even if the rotation and non-rotation of the toner carrying screw 62Y are repeated, the amount of toners to be supplied to the developing device 5Y can be controlled at high accuracy; that is, the toners can be stably supplied to the developing device 5Y. Consequently, the variation of the toner concentration in the developer G can be prevented. That is, the image density of an output image can be prevented from being high, the toners can be prevented from being scattered, and the background image can be prevented from being degraded.

In addition, even if the rotation and non-rotation of the toner carrying screw 62Y are repeated, a large amount of toners remaining in the toner carrying tube 63Y are not supplied to the developing device 5Y. Therefore, the amount of toners remaining in the toner tank 61Y is not greatly varied. Consequently, error detection by the toner end sensor 66Y can be prevented.

In FIG. 13, in order to surely obtain the above effect, it is preferable that the inclination angle $\alpha$ of the toner carrying screw 62Y and the toner carrying tube 63Y relative to the horizontal direction be 5 or more degrees ($\alpha \geq 5°$). However, when the inclination angle $\alpha$ becomes too large, the toner carrying ability by the toner carrying screw 62Y and the toner carrying tube 63Y is lowered and the height of the apparatus becomes great. Therefore, in the first embodiment of the present invention, the inclination angle $\alpha$ is determined to be approximately 10 degrees.

In addition, as shown in FIGS. 14, 15 and 17, the dropping part shutter 86 is attached to the toner dropping route 64Y, and the dropping part shutter 86 is opened or closed when the developing device 5Y is attached to or detached from the image forming apparatus main body 100. Specifically, when the developing device 5Y is attached to the image forming apparatus main body 100, the dropping part shutter 86 moves to open the toner dropping route 64Y by being pushed by the developing device 5Y against a force of a spring 87. When the developing device 5Y is detached from the image forming apparatus main body 100, the dropping part shutter 86 moves to close the toner dropping route 64Y by the force of the spring 87. With this, when the developing device 5Y is detached from the image forming apparatus main body 100, the toners cannot be scattered in the image forming apparatus main body 100 from the toner dropping route 64Y.

As shown in FIGS. 16 and 17, a seal member formed of a hair implantation seal 67Y, a sponge seal 68Y2, a sheet-shaped member 68Y3, and so on is adhered onto a part surrounding the toner supplying opening 60Ya of the toner tank 61Y. The sponge seal 68Y2 contacts a flange W2 of the toner outlet W (see FIG. 23) of the toner container 32Y and obtains the sealing capability between the toner tank 32Y and the toner tank 61Y. The sheet-shaped member 68Y3 is formed of a low friction material, contacts the shutter member 32Y1*a* (see FIG. 23) which is opened, and prevents the toners from being stayed between the shutter member 32Y1*a* and the toner tank 61Y. The hair implantation seal 67Y scrapes the toners adhered onto the surface of the shutter member 32Y1*a* with the detaching operation of the toner container 32Y from the image forming apparatus main body 100. The toners scraped by the hair implantation seal 67Y are dropped into the toner receiving section 85 via an opening 85*a* where a round surface 60Yc is formed.

Supply opening guides 69Y are at positions which sandwich the toner supplying opening 60Ya of the toner tank 61Y. The supply opening guides 69Y guide the flange W2 of the toner outlet W (see FIG. 23) and prevent the toner outlet W from being moved in the upward direction from the toner supplying opening 60Ya.

Figure 34:
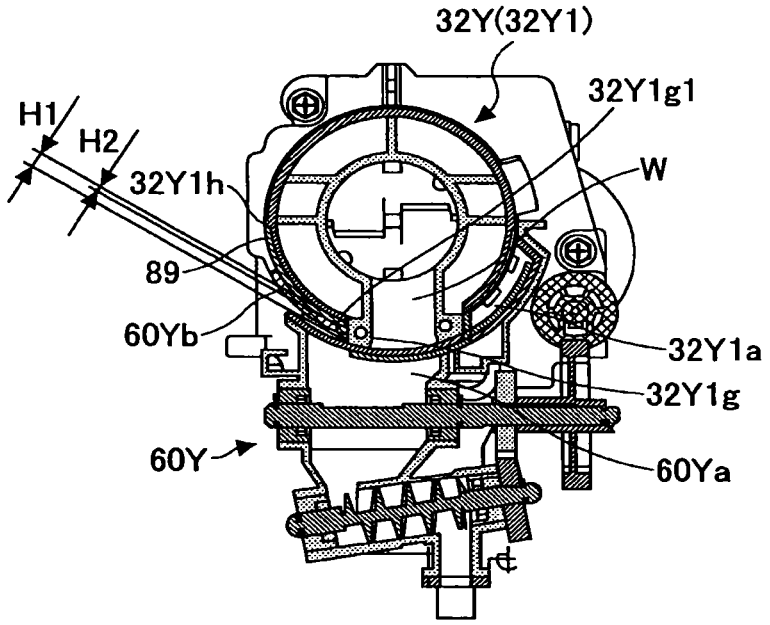
FIG. 34 is a schematic diagram when the toner container is attached to the toner supplying device.

As shown in FIGS. 18 and 34, the shutter 89 (main body side shutter), which opens or closes the toner supplying opening 60Ya connecting to the toner outlet W of the toner container 32Y (see FIG. 23), is positioned in the toner supplying device 60Y (the image forming apparatus main body 100). The shutter 89 is formed to have a curve so that the shutter 89 fits the circumferential surface of the toner container 32Y (the cap section 32Y1).

In addition, the toner supplying device 60Y includes a sliding surface (not shown) on which the shutter 89 slides in the circumferential direction of the toner supplying device 60Y. In order to fill a gap between the sliding surface and the shutter 89, a sealing member can be adhered onto the sliding surface.

The shutter 89 opens or closes the toner supplying opening 60Ya by being pushed by the cap section 32Y1 (a guiding member 32Y1*g* and a contacting section 32Y1*h*) together with an opening or closing operation of the shutter member 32Y1*a*. With this, the toner outlet W of the toner container 32Y is connected to the toner supplying opening 60Ya of the toner supplying device 60Y. The above elements are described below in detail.

As described above, the antenna substrate 120 (see FIG. 10) is positioned at the back side in the attaching direction (the right side of FIG. 32) of the toner containers 32Y, 32M, 32C, and 32K arrayed on the supporting part 115 of the toner container storing section 31. Therefore, toners are hardly dropped on the antenna 121 directly.

In the first embodiment of the present invention, since the antenna 121Y communicates with the electronic substrate 32Y1*c* without contact, the powder smoke of the toners are prevented from being dropped on the antenna 121Y as described below.

Figure 44:
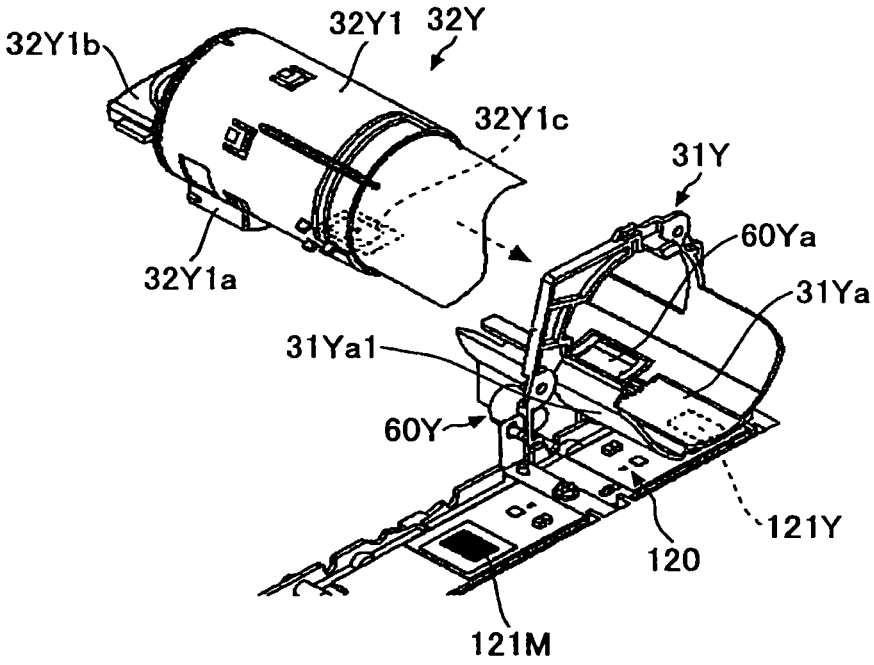
FIG. 44 is a perspective view of the toner supplying device to which the toner container has been attached.

As shown in FIG. 44, in the toner supplying device 60, at a position between the antenna 121Y and the electronic substrate 32Y1*c* when the toner container 32Y is attached to the toner supplying device 60Y, a brim section 31Ya is positioned to cover the antenna 121Y. That is, when the toner container 32Y is attached to the toner supplying device 60Y in the dotted-line arrow direction, the brim section 31Ya is positioned between the antenna 121Y and the electronic substrate 32Y1*c*, and communications are performed between the antenna 121Y and the electronic substrate 32Y1*c*.

Brim sections (not shown) are positioned between the antenna substrate 120 and the corresponding antennas 121M, 121C, and 121K.

Therefore, even if the attaching and detaching operations of the toner container 32Y to and from the toner supplying device 60Y are repeated, toners adhered onto the toner container 32Y can be prevented from being dropped on the antenna 121Y. Consequently, a communication failure between the antenna 121Y and the electronic substrate 32Y1*c* can be prevented.

Figure 45:
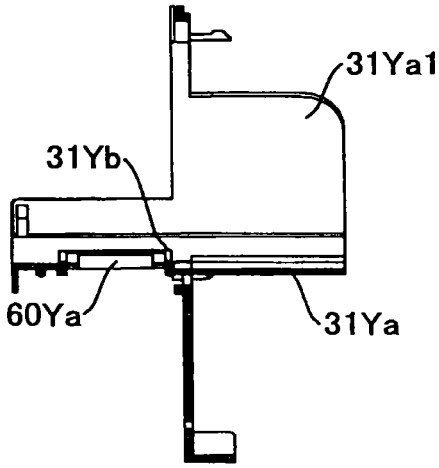
FIG. 45 is a diagram showing a part of the toner supplying device shown in FIG. 43.

As shown in FIG. 45, a partition section 31Yb is positioned between the toner supplying opening 60Ya to be connected to the toner outlet W of the toner container 32Y (the cap section 32Y1) and the brim section 31Ya. The partition section 31Yb is a wall member whose height is greater than the heights of the toner supplying opening 60Ya and the brim section 31Ya in the vertical direction. Therefore, the toners are prevented from flowing from the toner supplying opening 60Ya to the brim section 31Ya.

In addition, as shown in FIG. 44, the brim section 31Ya is formed to be a curved surface so that the circumferential surface of the toner container 32Y (the cap section 32Y1) fits the curved surface. That is, wall sections 31Ya1 are formed to cover the circumferential surface of the toner container 32Y (the cap section 32Y1) at both ends of the brim section 32Ya in the short length direction of the brim section 31Ya. In FIG. 44, one of the wall sections 31Ya1 is shown. With this, toners are prevented from flying to an adjacent antenna. Specifically, when the wall sections 31Ya1 are formed to the brim section 31Ya, the antenna 121M adjacent to the antenna 121Y is prevented from being contaminated by flying of the toners from the toner container 32Y.

In addition, since the brim section 31Ya is formed to be the curved surface, the toner container 32Y can be smoothly attached to or detached from the toner supplying device 60Y by being guided with the brim section 31Ya. With this, vibrations of the toner containers 32Y at the attaching or detaching operation of the toner container 32Y can be decreased, and toners adhered onto the toner container 32Y can be prevented from being flown and dropped.

The inventors of the present embodiment have performed an experiment. In the experiment, the toner container 32Y containing 200 g of toners was attached to and detached from the toner supplying device 60Y 30 times, and an amount of toners dropped and adhered onto the antenna 121Y was measured. The toners adhered onto the antenna 121Y were collected on a transparent tape, and the toners on the transparent tape were optically measured by using an ID measuring instrument X-Rite. When the ID value measured by the ID measuring instrument is great, the amount of adhered toners is great.

In the results of the experiment, when the brim section 31Ya was not the curved surface, the ID value was 0.09, when the brim section 31Ya was not the curved surface and the partition section 31Yb was formed, the ID value was 0.04, and when the brim section 31Ya was the curved surface and the partition section 31Yb was not formed, the ID value was 0.06. Further, when the brim section 31Ya was not formed, the ID value was 0.98. Therefore, when the brim section 31Ya was formed, an excellent effect was obtained.

Next, referring to FIGS. 19 through 35, the toner container 32Y is described in detail.

Figure 19:
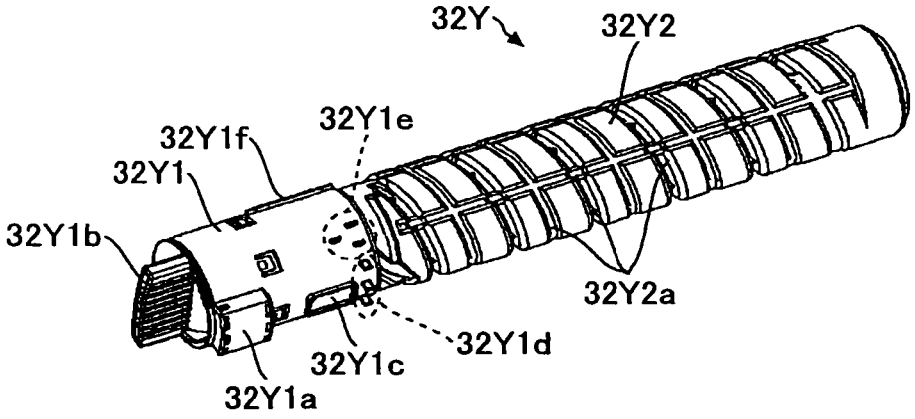
FIG. 19 is a perspective view of the toner container.
Figure 20:
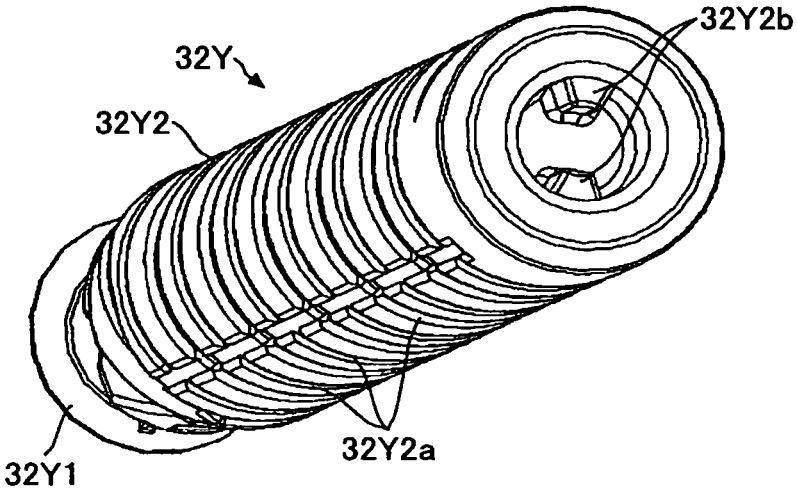
FIG. 20 is another perspective view of the toner container.
Figure 21:
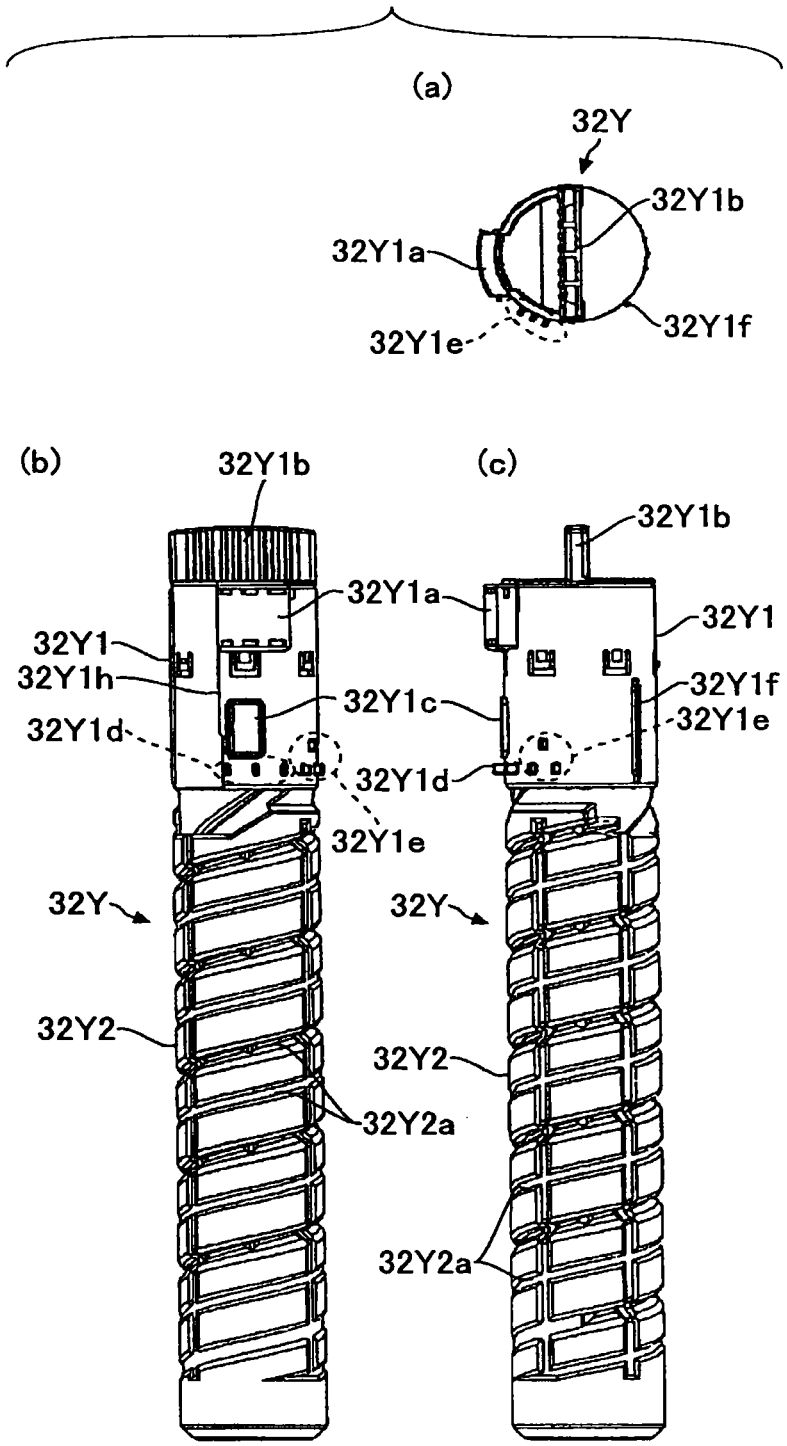
FIG. 21 is a diagram showing the toner container.

As shown in FIGS. 19 through 21, the toner container 32Y is a cylindrical container, and includes the cap section 32Y1 and the container main body 32Y2.

The container main body 32Y2 includes an opening section and the opening section is connected to the inside of the cap section 32Y1. A spiral protrusion 32Y2*a* is formed on the inner wall of the container main body 32Y2. The container main body 32Y2 is rotated in a predetermined direction by receiving a driving force from the driving coupling member 90 of the image forming apparatus main body 100 for engaging with the engaging sections 32Y2*b* formed at the bottom of the toner container 32Y. With this, toners in the toner container 32Y are carried toward the cap section 32Y1.

Figure 33:
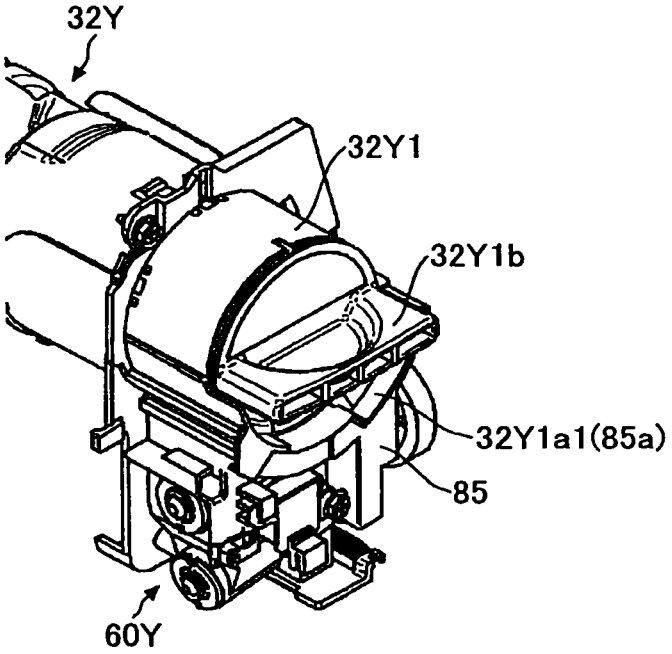
FIG. 33 is perspective view when the toner container is attached to the toner supplying device.

The toners discharged from the opening section of the container main body 32Y2 are output from the toner outlet W formed at the circumferential surface of the cap section 32Y1, and are supplied to the toner tank 61Y of the toner supplying device 60Y via the toner supplying opening 60Ya (see FIGS. 32 through 34).

Figure 24:
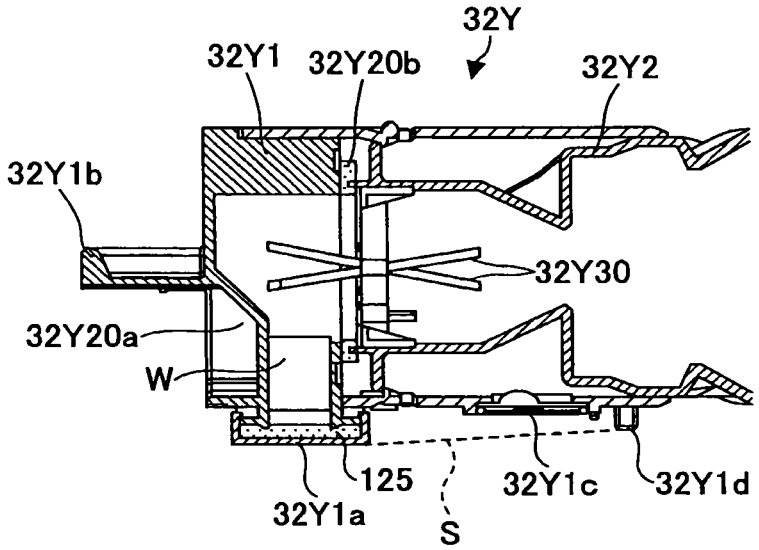
FIG. 24 is a cut-away side view of the head part of the toner container.

As shown in FIG. 24, two scrapers 32Y30 are positioned at the opening section of the container main body 32Y2. The scrapers 32Y30 are rotated together with the container main body 32Y2, and effectively move the toners near the opening section of the container main body 32Y2 to the side of the cap section 32Y1.

In FIG. 20, the two engaging sections 32Y2*b* for engaging with claw members of the driving coupling member 90 of the image forming apparatus main body 100 are positioned by having a distribution angle of 180 degrees with the rotational center axis of the container main body 32Y2 as the reference.

The number of the engaging sections 32Y2*b* of the toner container 32Y can be three or more by forming the three or more claw members of the driving coupling member 90 of the image forming apparatus main body 100 in which the distribution angle is determined to be a suitable angle with the rotational center axis of the container main body 32Y2 as the reference. In this case, when the toner container 32Y is rotated, torque variation can be decreased. However, a probability may be increased in which the engaging sections 32Y2*b* interfere with the claw members when the toner container 32Y is attached to the image forming apparatus main body 100. Therefore, the number of the engaging sections 32Y2*b* and the claw sections must be determined by considering the toner outputting capability from the toner container 32Y determined by the torque variation and the attaching capability of the toner container 32Y to the image forming apparatus 100 determined by the interference between the engaging sections 32Y2*b* and the claw sections.

When the toner container 32Y is attached to the toner supplying device 60Y, the cap section 32Y1 is secured to the toner supplying device 60Y. That is, after attaching the toner container 32Y to the toner supplying device 60Y, the cap section 32Y1 is not rotated, and only the container main body 32Y2, which is rotatably supported by the cap section 32Y1, is rotated.

The sealing capability between the cap section 32Y1 and the container main body 32Y2 is obtained by a sealing member 32Y20*b* (see FIG. 29) adhered onto a handle main body 32Y20. That is, as shown in FIG. 24, since the opening section of the container main body 32Y2 breaks into the sealing member 32Y20*b* of the cap section 32Y1, the toners are prevented from being leaked from a position between the cap section 32Y1 and the container main body 32Y2.

Figure 35:
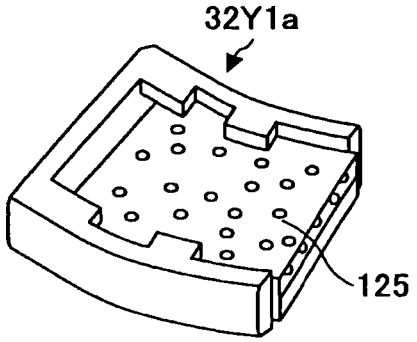
FIG. 35 is a perspective view of an elastic member.

As shown in FIGS. 22 through 25, the cap section 32Y1 includes the toner outlet W, the shutter member 32Y1*a*, the guiding member 32Y1*g*, the contacting section 32Y1*h*, a pushing member 32Y1*k*, the electronic substrate 32Y1*c*, a protrusion member 32Y1*d* (a non-compatible identification member), a rib 32Y1*e* (a color identifying rib), the guide rib 32Y1*f*, the handle part 32Y1*b*, and an elastic member 125 (see FIG. 35). In addition, the guiding member 32Y1*g* includes a protrusion W1 and the flange W2.

The cap section 32Y1 is formed by engaging a cap section main body 32Y10 with the handle main body 32Y20 (see FIG. 29), and the cap section main body 32Y10 is adhered to the handle main body 32Y20 by using the rib 32Y20*c* as the adhering surface.

The shutter member 32Y1*a* opens or closes the toner outlet W when the toner container 32Y is attached to or detached from the toner supplying device 60Y.

Specifically, when the toner container 32Y is attached to the toner supplying device 60 (the image forming apparatus main body 100), a user inserts the container main body 32Y2 of the toner container 32Y into the inserting opening 110Y (see FIG. 9) of the image forming apparatus main body 100 from the bottom section of the container main body 32Y2 while holding the handle part 32*y*1*b* of the toner container 32Y. At this time, the rotation of the cap section 32Y1 is stopped by engaging the inserting opening 110Y and the guide rib 32Y1*f* on the cap section main body 32Y10 with a first guide groove 111Y.

After this, when the toner container 32Y is further pushed while the rotation is stopped, the protrusion member 32Y1*d* and the rib 32Y1*e* exceed the second guide grooves 112Y. After engaging the engaging sections 32Y2*b* formed at the bottom of the toner container 32Y with the driving coupling member 90 of the image forming apparatus main body 100, when the handle part 32Y1*b* is manually rotated by approximately 90 degrees clockwise, the protrusion member 32Y1*d* is engaged with a stopping member of the toner supplying device 60Y, the toner container 32Y is stopped, and the toner outlet W is opened. At this time, the toner outlet W engages with toner supplying opening 60Ya of the toner tank 61Y (see FIGS. 32 through 34), and the cap section 32Y1 is secured to the toner supplying device 60Y.

When the toner container 32Y is detached from the toner supplying device 60Y (the image forming apparatus 100), an operation reverse to the above attaching operation is performed.

In addition, the toner supplying opening 60Ya is opened when the shutter 89 of the toner supplying device 60Y is pushed by the cap section 32Y1 by the movement of the shutter member 32Y1*a* (the rotation of the cap section 32Y1 of the toner container 32Y) (see FIGS. 18 and 34).

Figure 29:
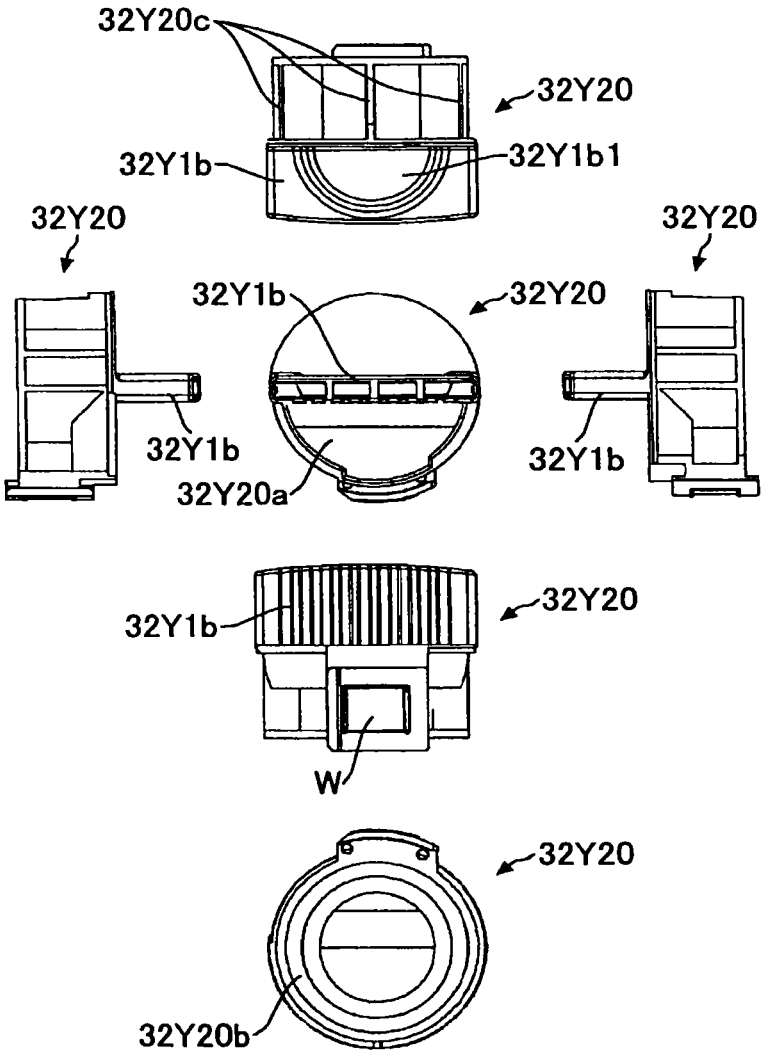
FIG. 29 is a diagram showing a handle main body of the toner container.
Figure 30:
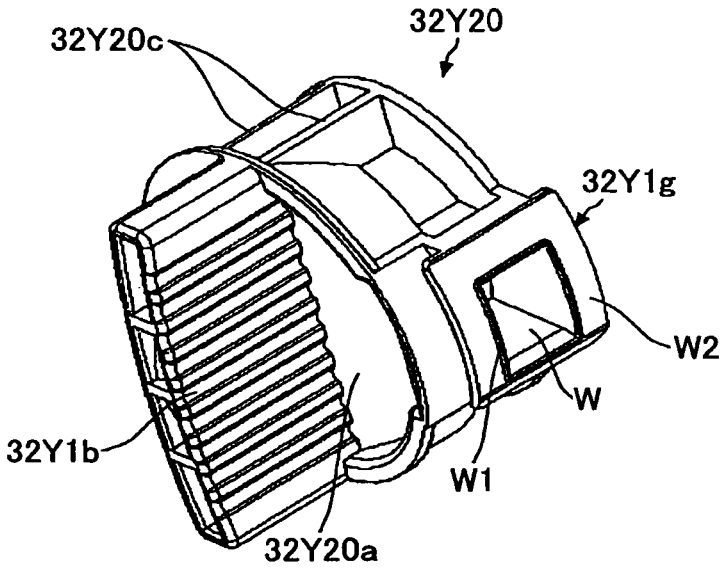
FIG. 30 is a perspective view of the handle main body of the toner container.
Figure 31:
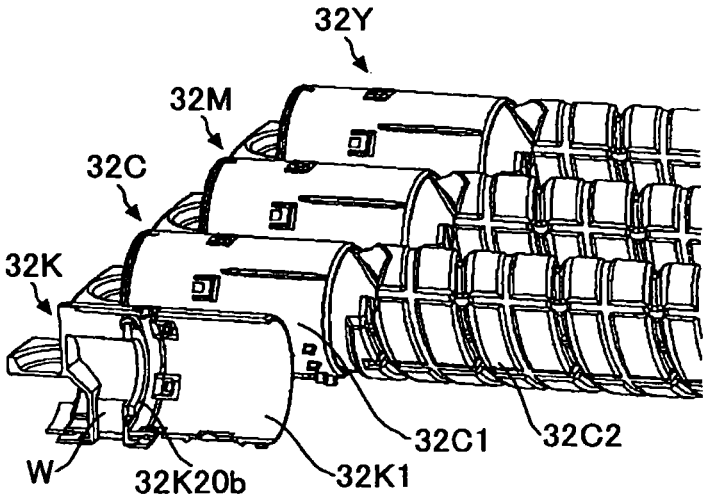
FIG. 31 is a perspective view of a part of the toner container.

In FIG. 29, in order to increase the operability of the handle part 32Y1*b*, a concave section 32Y1*b*1 is formed in the upper surface of the handle part 32Y1*b* and a concave section 32Y20*a* is formed under the handle part 32Y1*b* in the handle main body 32Y20.

Figure 22:
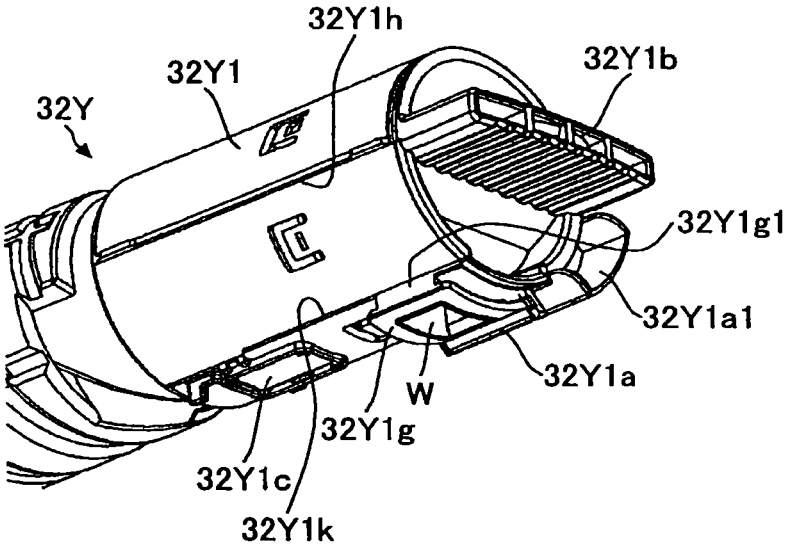
FIG. 22 is a perspective view of a head part of the toner container when a shutter member is opened.

In FIG. 22, the guiding member 32Y1*g* is formed to surround the toner outlet W in the cap section 32Y1 so as to protrude from the circumferential surface of the cap section 32Y1. The guiding member 32Y1*g* is formed to engage with a grove (see FIG. 35) formed in the inner wall of the shutter member 32Y1*a*, and guides the opening or closing operation of the shutter member 32Y1*a* in the circumferential direction.

Figure 23:
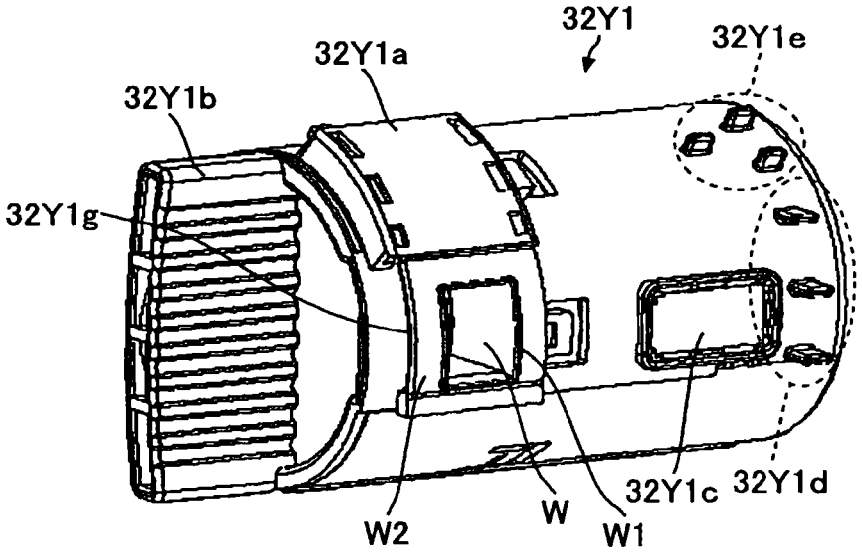
FIG. 23 is a perspective view of a cap section of the toner container.

In FIG. 23, the guiding member 32Y1*g* includes the protrusion W1 and the flange W2 to surround the protrusion W1. When the shutter member 32Y1*a* closes the toner outlet W, the protrusion W1 breaks into the elastic member 125 (see FIG. 35) adhered onto the back surface of the shutter member 32Y1*a*, and provides a good sealing capability between the toner outlet W and the shutter member 32Y1*a*. In addition, when the shutter member 32Y1*a* opens the toner outlet W, the protrusion W1 breaks into a sealing member (not shown) adhered onto a surrounding part of the toner supplying opening 60Ya (see FIG. 18), and provides a good sealing capability between the toner outlet W and the toner supplying opening 60Ya.

The electronic substrate 32Y1*c* has a function of, for example, an RFID, and as described above, communicates with the antenna substrate 120 (see FIG. 10) for communicating information between the toner container 32Y and the image forming apparatus main body 100.

The protrusion member 32Y1*d* (non-compatible identification member) prevents a different type of toner container from being attached to the image forming apparatus main body 100 in the long length direction. For example, when a manufacturer produces an image forming apparatus under a model name of another company, and supplies a toner container under the name of the company, the protrusion member 32Y1*d* is formed to identify the toner container 32Y. The protrusion member 32Y1*d* is formed to sandwich the electronic substrate 32Y1*c* with the shutter member 32Y1*a* when the toner outlet W is closed.

The protrusion member 32Y1*d* includes three protrusions right after the molding. When a toner container is used between different image forming apparatuses, the breaking position of the protrusion is different between the toner containers. For example, when two image forming apparatuses are manufactured under two model names of different companies, the protrusion at the upper position is broken for a first company and the protrusions at the upper and lower positions are broken for a second company. In this case, the shape of the grove, through which the protrusion member 32Y1*d* passes, is changed in the image forming apparatus main body 100.

Figure 25:
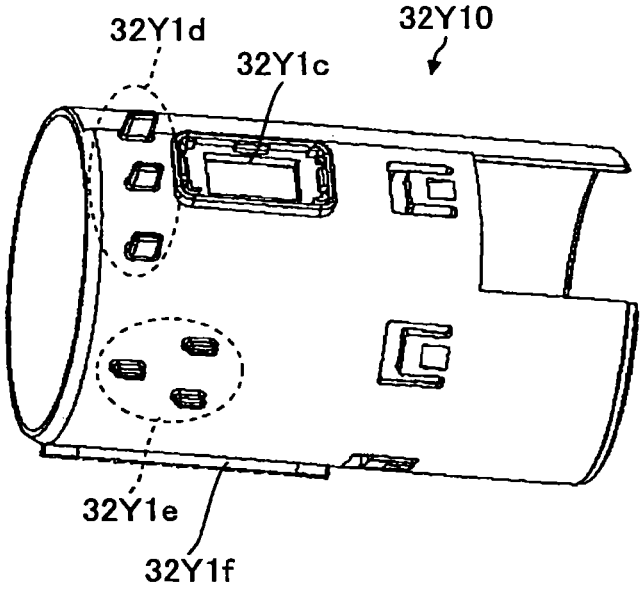
FIG. 25 is a perspective view of a cap section main body of the toner container for yellow.
Figure 26:
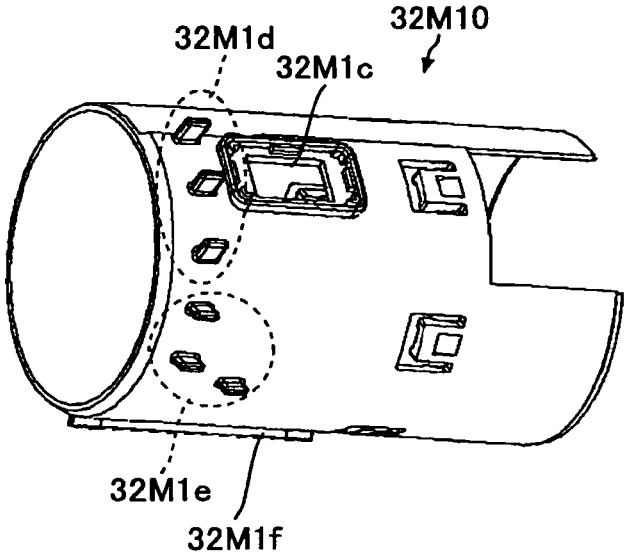
FIG. 26 is a perspective view of a cap section main body of the toner container for magenta.
Figure 27:
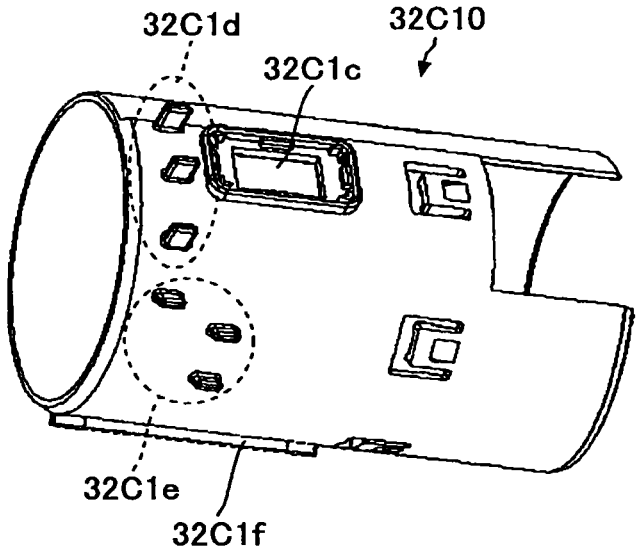
FIG. 27 is a perspective view of a cap section main body of the toner container for cyan.
Figure 28:
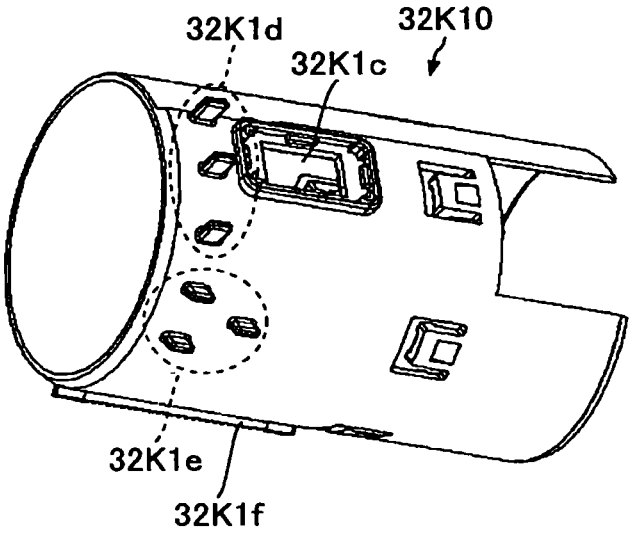
FIG. 28 is a perspective view of a cap section main body of the toner container for black.

In FIG. 25, the protrusion member 32Y1*e* is formed so that the toner container 32M, 32C, or 32K different from the toner container 32Y is not wrongly inserted into the inserting opening 110Y of the toner supplying device 60Y (see FIG. 9). That is, ribs of the protrusion member 32Y1*e* shown in FIG. 25, ribs of the protrusion member 32Mle shown in FIG. 26, ribs of the protrusion member 32C1*e* shown in FIG. 27, and ribs of the protrusion member 32K1*e* shown in FIG. 28 are positioned different from each other. That is, the protrusion members 32Y1*e*, 32M1*e*, 32C1*e*, and 32K1*e* are engaged with the corresponding second guide groove 112Y, 112M, 112C, and 112K of the inserting openings 110Y, 110M, 110C, and 110K (see FIG. 9).

In addition, in FIGS. 19, and 25 through 28, the guide ribs 32Y1*f*, 32M1*f*, 32C1*f*, and 32K1*f* guide the corresponding toner containers 32Y, 32M, 32C, and 32K to the inserting openings 110Y, 110M, 1100, and 110K of the toner supplying devices 60Y, 60M, 60C, and 60K with normal positioning.

When the shutter member 32Y1*a* has closed the toner outlet W (states shown in see FIGS. 19 and 24) and the toner container 32Y is put on an arbitrary flat surface (for example, a floor), the shutter member 32Y1*a* and a part of the toner container 32Y form supporting points, and the electronic substrate 32Y1*c* does not contact the floor.

Specifically, as shown in FIGS. 21(*a*), 46 (*a*), and 46(*b*), when the shutter member 32Y1*a* has closed the toner outlet W, the electronic substrate 32Y1*c* is inside a projection region of the toner container 32Y including the shutter member 32Y1*a* viewed from the long length direction.

As shown in FIG. 24, the electronic substrate 32Y1*c* is positioned by being sandwiched between the shutter member 32Y1*a* and the protrusion member 32Y1*d*. With this, the shutter member 32Y1*a* and the protrusion member 32Y1*d* form the supporting points and the electronic substrate 32Y1*c* does not contact the flat surface. That is, in FIG. 24, the electronic substrate 32Y1*c* is positioned in a region which does not exceed a virtual dotted line S connecting the shutter member 32Y1*a* to the protrusion member 32Y1*d*.

With this, even if the toner container 32Y is not attached to the image forming apparatus main body 100 and is put on a flat surface, for example a floor, the shutter member 32Y1*a* and the protrusion member 32Y1*d* form the supporting points and the electronic substrate 32Y1*c* does not contact the flat surface. Therefore, the electronic substrate 32Y1*c* is prevented from being broken, the image forming apparatus is prevented from being large sized in the inserting direction of the toner container 32Y, and the sensitivity of the communications between the electronic substrate 32Y1*c* and the antenna 121Y of the image forming apparatus main body 100 is not restricted.

Figure 46:
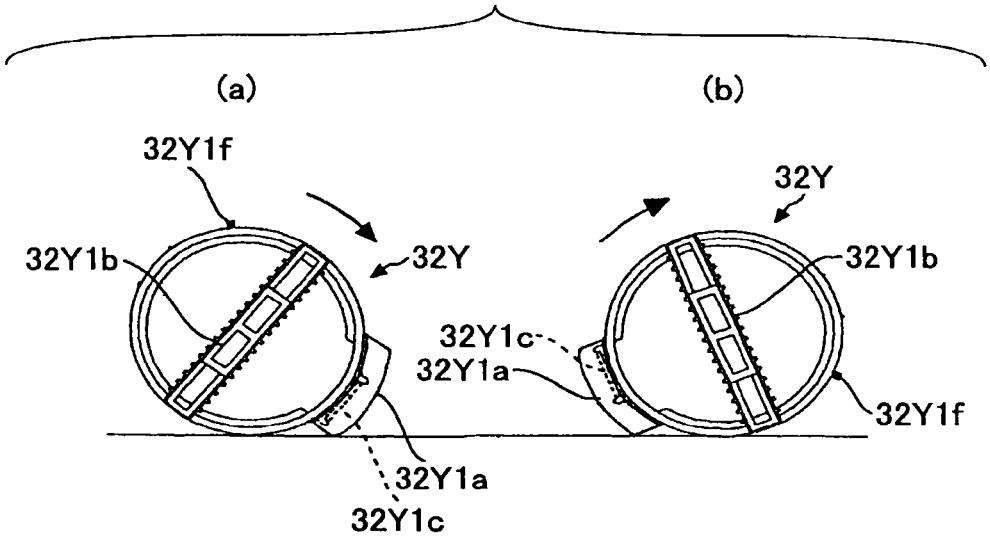
FIG. 46 is a diagram showing rolling states of the toner container.

As shown in FIG. 25, the guide rib 32Y1*f* extends in the long length direction of the cap section main body 32Y20, and also functions not to rotate the cap section main body 32Y20 (the toner container 32Y) in the circumferential direction of the toner container 32Y. Specifically, as shown in FIG. 46, when the toner container 32Y is rotated in the arrow direction shown in FIG. 46(*a*), the shutter member 32Y1*a* functions as a stopper, and when the toner container 32Y is rotated in the arrow direction shown in FIG. 46(*b*), the guide rib 32Y1*f* functions as a stopper. With this, the rotational range of the toner container 32Y is restricted.

In FIG. 25, the length of the guide rib 32Y1*f* is formed to include the length of the electronic substrate 32Y1*c* and the length of the protrusion member 32Y1*e* in the horizontal direction. With this, when the toner container 32Y is attached to (detached from) the toner supplying device 60Y, the electronic substrate 32Y1*c* is prevented from being broken by touching to the inserting opening 110Y, and the cap section 32Y1 is prevented from being interfering with the inserting opening 110Y by being rotated.

In FIG. 35, the elastic member 125 is adhered on the back surface of the shutter member 32Y1*a* and faces the toner outlet W when the toner outlet W is closed, and also functions to absorb an external force when the external force is applied to the shutter member 32Y1*a*. With this, when the shutter member 32Y1*a* functions to be one of the supporting points to prevent the electronic substrate 32Y1*c* from being broken, the toner outlet W can be prevented from being damaged by the external force.

In addition, as described above, even if the elastic member 125 is compressed in a state where the shutter member 32Y1*a* closes the toner outlet w, the electronic substrate 32Y1*c* does not contact a flat surface by the supporting points formed by the shutter member 32Y1*a* and the protrusion member 32Y1*d* when the toner container 32Y is put on the flat surface. With this, even if the elastic member 125 is deformed by an external force, the electronic substrate 32Y1*c* can be prevented from being broken.

As described above, in the first embodiment of the present invention, the antenna substrate 120 is formed in which the antennas 121Y, 121M, 121C, and 121K for facing the electronic substrates 32Y1*c*, 32M1*c*, 32C1*c*, and 32K1*c* positioned on the corresponding circumferential surfaces of the toner containers 32Y, 32M, 32C, and 32K are formed on the supporting part 115. With this, the image forming apparatus main body 100 (the toner supplying devices 60Y, 60M, 60C, and 60K) is not caused to be great in the toner container inserting direction, can be manufactured at low cost with relatively low-cost components, and the assembling ability of the image forming apparatus main body 100 can be high.

Next, the structure and operations of the guiding member 32Y1*g* and the shutter member 32Y1*a* in the toner container 32Y, and the shutter 89 (main body side shutter) are described in detail.

As shown in FIG. 22, the guiding member 32Y1*g* is formed to surround the toner outlet W so as to protrude from the toner outlet W in the cap section 32Y1 of the toner container 32Y.

The guiding member 32Y1*g* is engaged with a groove (not shown) formed in the inner wall of the shutter member 32Y1*a*, and guides the shutter member 32Y1*a* so that the shutter member 32Y1*a* moves in the circumferential direction of the toner container 32Y (the shutter member 32Y1*a* opens (closes) the toner outlet W.

When the shutter member 32Y1*a* opens the toner outlet W, an end surface 32Y1*g*1 of the guiding member 32Y1*g* pushes the shutter 89 (see FIG. 18), and the toner supplying opening 60Ya is opened. With this, the toner supplying opening 60Ya is connected to the toner outlet W. At this time, the end surface 32Y1*g*1 of the guiding member 32Y1*g* contacts an end part 89*a* of the shutter 89 (see FIG. 18).

Therefore, even if toners are adhered onto the surrounding part of the toner supplying opening 60Ya, the shutter member 32Y1*a* is surely engaged with the shutter 89, and the shutter 89 is surely opened by interfacing with the opening operation of the shutter member 32Y1*a* (the rotational operation of the cap section 32*y*1). With this, an abnormal connection of the toner outlet W with the toner supplying opening 60Ya can be prevented. In addition, since toners dropped from the toner container 32Y to a part surrounding the toner supplying opening 60Ya are hidden by the shutter 89, stains caused by the dropped toners is hardly visible by the user when the toner container 32Y is replaced with a new one. Thus, an unsatisfying impression is not given to the user.

In the first embodiment of the present invention, in addition to the end surface 32Y1*g*1, the pushing member 32Y1*k* is formed which pushes the shutter 89 together with the end surface 32Y1*g*1 when the shutter member 32Y1*a* opens the toner outlet W. The pushing member 32Y1K is a step formed in the circumferential surface of the cap section 32Y1 so that the surface of the step becomes the same level as the end surface 32Y1*g*1 of the guiding member 32Y1*g*. The pushing member 32Y1*k* pushes the shutter 89 (see FIG. 18) together with the end surface 32Y1*g*1 of the guiding member 32Y1*g* in contact with the end part 89*a* of the shutter 89 by moving with the opening operation of the shutter member 32Y1.

The shutter 89 is pushed in a balanced manner by forming the pushing member 32Y1*k*. The shape of the pushing member 32Y1*k* is not limited to that shown in FIG. 22, and can be, for example, an erect pin on the circumferential surface of the cap section 32Y1.

As shown in FIGS. 18 and 22, the contacting section 32Y1*h* is formed to protrude from the circumferential surface of the cap section 32Y1 of the toner container 32Y. The contacting section 32Y1*h* contacts an end part 89*b* of the shutter 89 which contacts the end surface 32Y1*g*1 of the guiding member 32Y1*g*, and supports the shutter 89 by sandwiching with guiding member 32Y1*g*. When the shutter member 32Y1*a* is closed (the toner outlet W is closed), the contacting section 32Y1*h* pushes the shutter 89, and the toner supplying opening 60Ya is closed.

With this, since toners dropped from the toner container 32Y to a part surrounding the toner supplying opening 60Ya are hidden by the shutter 89, stains caused by the dropped toners is hardly visible by the user when the toner container 32Y is replaced with a new one. Thus, an unsatisfying impression is not given to the user.

As shown in FIGS. 19 and 22, a brim section 32Y1*a*1 extending in the long length direction of the toner container 32Y is formed in the shutter member 32Y1*a*. The brim section 32Y1*a*1 covers the opening 85*a* of the toner receiving section 85 (see FIG. 33) when the toner container 32Y is attached to the toner supplying device 60Y. With this, toners collected in the toner receiving section 85 are not visible from the user, and as a result, an unsatisfying impression is not given to the user. The brim section 32Y1*a*1 is not shown in the drawings other than in FIGS. 19, 22, 33, and 41.

Figure 41:
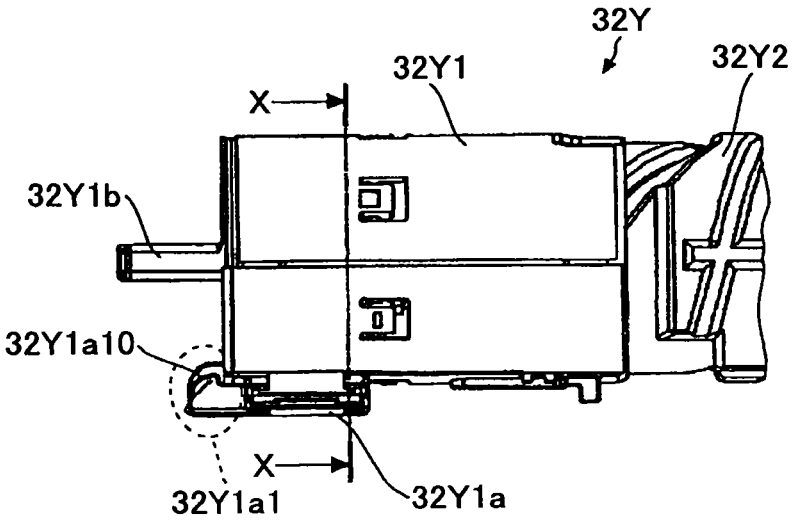
FIG. 41 is a cut-away side view of the head part of the toner container.

As shown in FIG. 41, the brim section 32Y1*a*1 extends to protrude in the right direction (the detaching direction of the toner container 32Y) from the cap section 32Y1 so that the circumferential surface of the shutter member 32Y1*a* extends to have the same curvature factor as the curvature factor of the circumferential surface of the cap section 32Y1.

Figure 47:
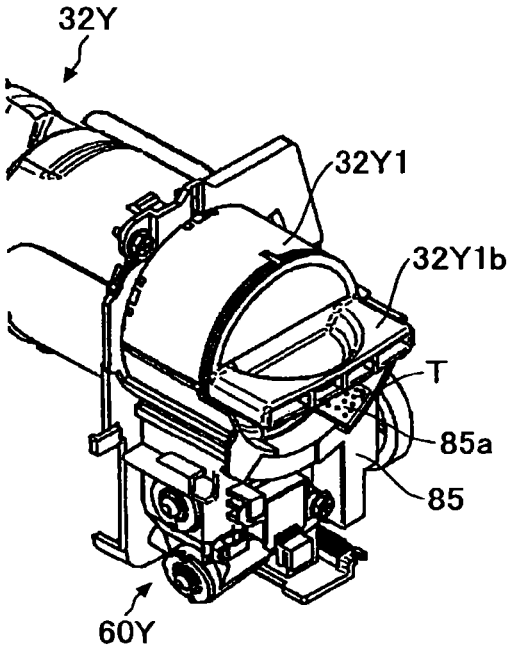
FIG. 47 is a perspective view of the toner supplying device when a brim section is not formed in the shutter member.

As shown in FIG. 33, when the toner container 32Y is attached to the toner supplying device 60Y (the image forming apparatus main body 100), toners collected in the toner receiving section 85 cannot be viewed by the user who attaches the toner container 32Y to the toner supplying device 60Y. That is, as shown in FIG. 47, when the brim section 32Y1*a*1 is not formed in the toner container 32Y, toners in the toner receiving section 85 are visible by the user, and an unsatisfying impression may be given to the user.

Figure 40:
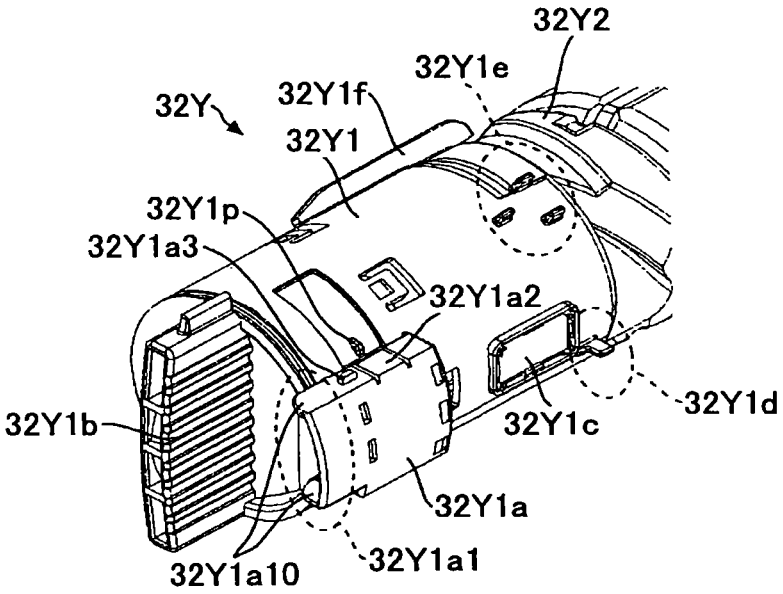
FIG. 40 is a perspective view of the head part of the toner container.

As shown in FIGS. 40 and 41, protrusions 32Y1*a*10 are formed in the brim section 32Y1*a*1 of the shutter member 32Y1*a* so that the shutter member 32Y1*a* is prevented to be assembled with the toner container 32Y (the cap section 32Y1) in the wrong direction. The protrusions 32Y1*a*10 are formed so that the wall surfaces of the shutter member 32Y1*a* extend from the end surface of the cap section 32Y1.

With this, in the manufacturing process of the toner container 32Y, in a case where the shutter member 32Y1*a* is assembled with the cap section 32Y1 to be guided by a guiding member (not shown) formed in the cap section 32Y1, when the shutter member 32Y1*a* is assembled in a wrong direction, the protrusions 32Y1*a*10 are run on the circumferential surface of the cap section 32Y1, and the shutter member 32Y1*a* cannot be assembled with the cap section 32Y1. That is, the shutter member 32Y1*a* is formed to assemble with the cap section 32Y1 in only the one direction (the right direction). With this, the productivity of the toner container 32Y can be increased.

As shown in FIG. 40, in the toner container 32Y, a control unit is formed in the shutter member 32Y1*a* so that the toner outlet W is not opened when a force other than a predetermined external force is applied to the shutter member 32Y1*a*. The control unit includes an elastic part 32Y1*a*2 formed on a side wall of the shutter member 32Y1*a* and a slope part 32Y1*p* formed on the circumferential surface of the cap section 32Y1. Notches are formed at the both sides of the elastic part 32Y1*a*2 and when a force exceeding the predetermined external force is applied to the shutter member 32Y1*a*, the elastic part 32Y1*a*2 is bent independently from the main part of the shutter member 32Y1*a*. The height of the slope part 32Y1*p* is first gradually increased and then gradually decreased in the circumferential direction, and is positioned near the elastic part 32Y1*a*2 when the shutter member 32Y1*a* closes the toner outlet W.

With this, when the shutter member 32Y1*a* is moved to open the toner outlet W, the elastic part 32Y1*a*2 runs over the slope part 32Y1*p* by being deformed. That is, when a force having a predetermined amount or more is not applied to the shutter member 32Y1*a*, the elastic part 32Y1*a*2 does not run over the slope part 32Y1*p*, and the toner outlet W is not opened.

Therefore, toners in the toner container 32Y are prevented from being leaked in cases in which a small external force is applied to the shutter member 32Y1*a* of the toner container 32Y during the transportation of the toner container 32Y and a user accidentally touches the shutter member 32Y1 of the toner container 32Y. The overlapping amount (the running over amount) between the elastic part 32Y1*a*2 and the slope part 32Y1*p* is determined to be approximately 0.1 to 1.0 mm.

Figure 42:
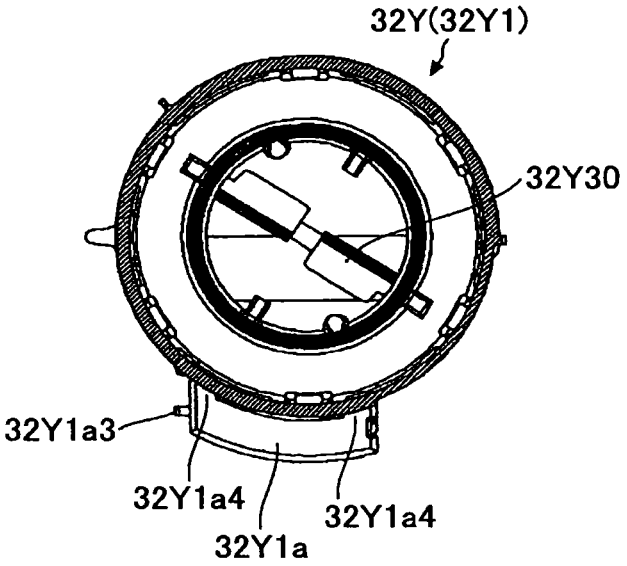
FIG. 42 is a cross-sectional view of the toner container along line X-X of FIG. 41.
Figure 43:
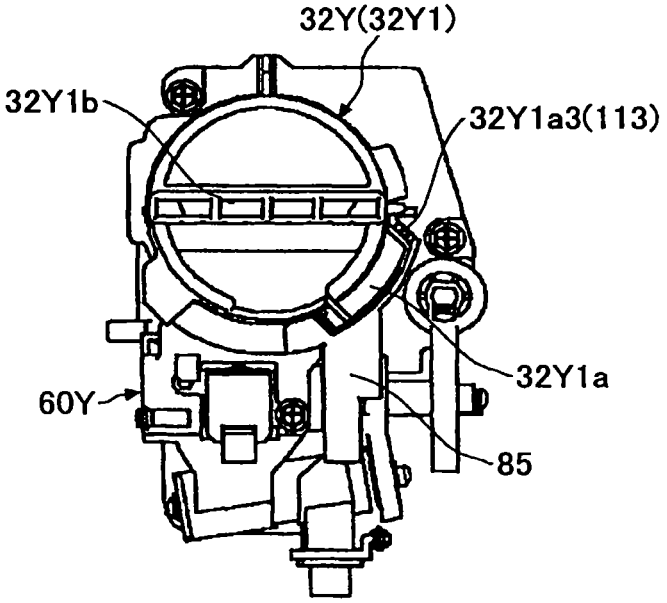
FIG. 43 is a front view of the toner supplying device to which the toner container has been attached.

As shown in FIG. 42, in order to prevent a rough movement of the shutter member 32Y1 relative to the cap section 32Y1, two protrusions 32Y1*a*4 are formed on the circumferential surface of the cap section 32Y1 at positions separated from each other. The protrusions 32Y1*a*4 support the shutter member 32Y1*a* by two points at the back side orthogonal to the opening and closing direction of the shutter member 32Y1*a* (the right side in FIG. 41).

With this, when this case is compared with a case where the shutter member 32Y1*a* is supported by the cap section 32Y1 at one side, in this case, the rough movement of the shutter member 32Y1*a* relative to the cap section 32Y1 does not occur in the circumferential direction of the cap section 32Y1. Therefore, the sealing capability by the elastic member 125 (see FIG. 35) positioned between the shutter member 32Y1*a* and the cap section 32Y1 can be increased. That is, a leakage of toners from a position between the shutter member 32Y1*a* and the cap section 32Y1 is decreased, and stains of the shutter member 32Y1 caused by toners is decreased.

As described above, in the first embodiment of the present invention, the brim section 32Y1*a*1 is formed to cover the opening 85*a* of the toner receiving section 85 in the shutter member 32Y1*a* which opens or closes the toner outlet W in a attaching or detaching state of the toner container 32Y to or from the toner supplying device 60Y. With this, stains caused by toners when the toner container 32Y is replaced with a new one can be decreased, and the toners collected in the toner receiving section 85 are not visible from the user, and thus an unsatisfying impression is not given to the user.

In FIG. 34, when a distance from the circumferential surface of the cap section 32Y1 to the external circumferential surface of the guiding section 32Y1*g* is defined as H1 and a distance from the circumferential surface of the cap section 32Y1 to a sliding surface 60Yb (the sliding surface of the shutter 89) of the toner supplying device 60Y is defined as H2, the following relationship is obtained.

$$H1 \geq H2$$

That is, the guiding section 32Y1*g* enters into the toner supplying device 60Y.

With this, when the toner container 32Y is attached to the toner supplying device 60Y, the shutter member 32Y1*a* of the toner container 32Y is surely engaged with the shutter 89 (of the main body side). The thickness of the shutter 89 is determined to be the distance H2 or less.

Figure 48:
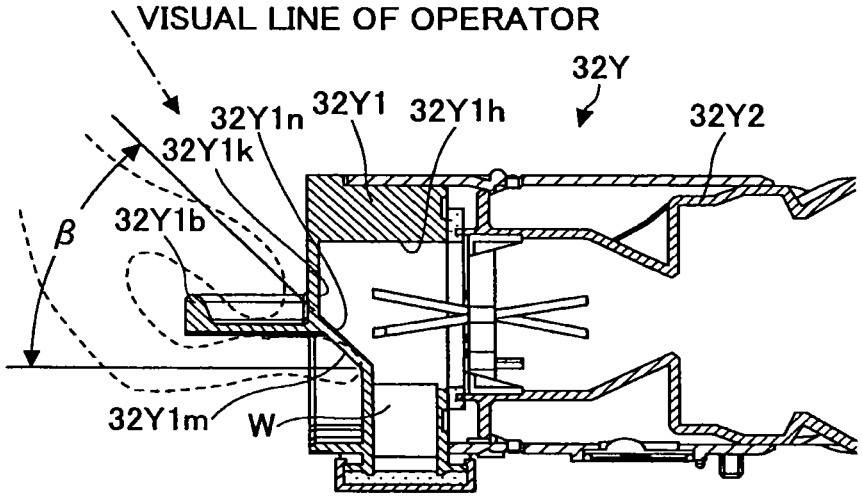
FIG. 48 is another cut-away side view of the head part of the toner container.

In FIG. 48, in the toner container 32Y, inner walls of the cap section 32Y1 are formed of a ceiling surface 32Y1*h*, a slant surface 32Y1*n*, and a vertical surface 32Y1*k*. The ceiling surface 32Y1*h* is formed of a part of a cylindrical surface. That is, the inner walls of the cap section 32Y1 (supported section) do not include a horizontal surface. Specifically, in the cap section 32Y1, the slant surface 32Y1*n* toward the toner outlet W is formed at the head part and the inner walls other than the ceiling surface 32Y1*n* are vertical walls.

With this, toners hardly remain in the cap section 32Y1 when the toners have been almost consumed (at the toner end time). Specifically, when the remaining amount of toners in the toner container 32Y becomes small, toners on the slant surface 32Y1*n* slide down and are discharged from the toner outlet W.

In order to surely obtain the above effect, in FIG. 48, the angle β of the slant surface 32Y1*n* is preferably to be the repose angle of the toners or more. In FIG. 48, a visual line of an operator (user) is shown.

As described above, in the first embodiment of the present invention, when the shutter member 32Y1*a* of the toner container 32Y is opened, the end surface 32Y1*g*1 of the guiding member 32Y1*g* pushes the shutter 89 together with the opening operation of the shutter member 32Y1*a*. With this, the toner supplying opening 60Ya of the toner supplying device 60Y is opened, and the toner outlet W of the toner container 32Y is connected to the toner supplying opening 60Ya. Therefore, toners are smoothly supplied to the toner supplying device 60Y from the toner container 32Y. Even if toners are dropped from the toner container 32Y to a part surrounding the toner supplying opening 60Ya, the dropped toners are not visible from a user, and the unsatisfying impression is not given to the user.

In addition, as described above, in the first embodiment of the present invention, the antennas 121Y, 121M, 121C, and 121K for facing the electronic substrates 32Y1*c*, 32M1*c*, 32C1*c*, and 32K1*c* positioned on the corresponding circumferential surfaces of the toner containers 32Y, 32M, 32C, and 32K arrayed on the supporting part 115 of the image forming apparatus main body 100 are positioned on the antenna substrate 120. With this, the image forming apparatus main body 100 (the toner supplying devices 60Y, 60M, 60C, and 60K) is not caused to be great in size in the toner container inserting direction, and as a result, can be manufactured at low cost with relatively low-cost components, and the assembling efficiency of the image forming apparatus main body 100 can be high.

Second Embodiment

Figure 36:
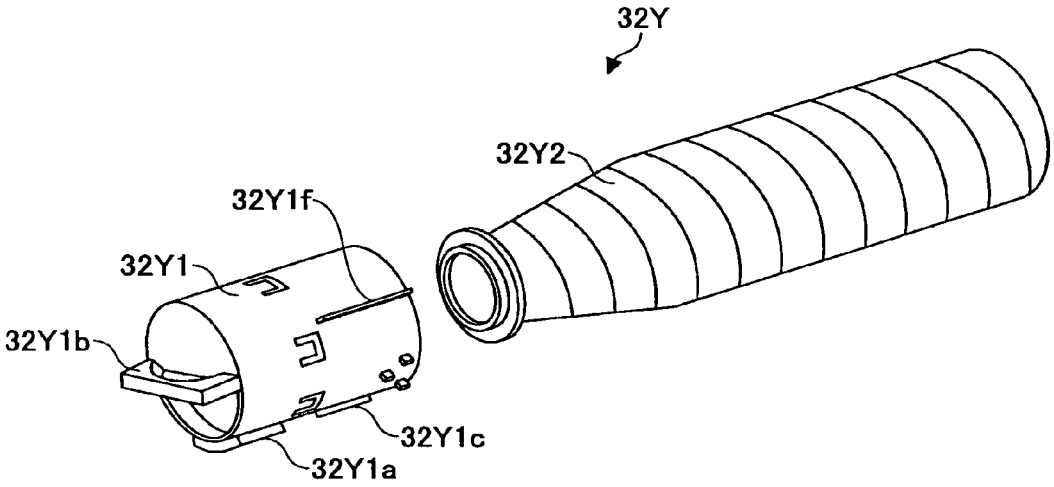
FIG. 36 is a perspective view of a toner container according to a second embodiment of the present invention.
Figure 37:
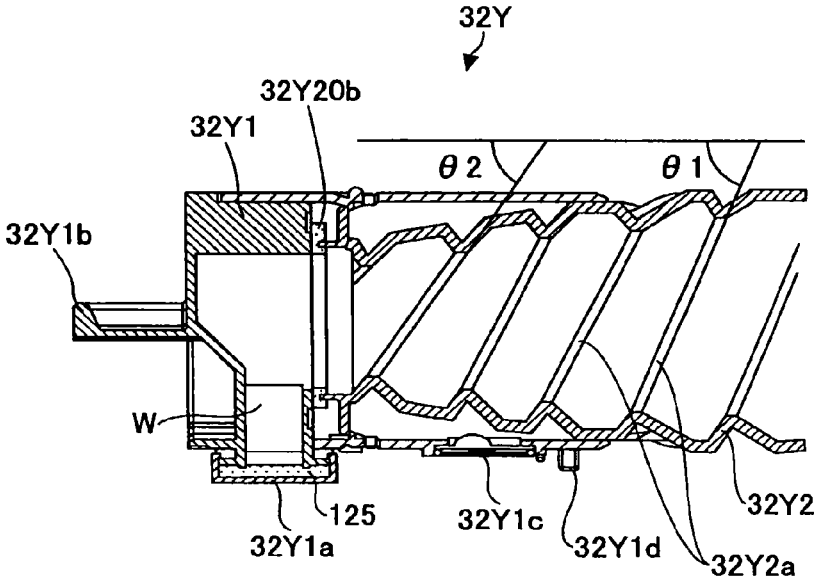
FIG. 37 is a cut-away side view of a head part of the toner container shown in FIG. 36.

Next, referring to FIGS. 36 and 37, a second embodiment of the present invention is described. FIG. 36 is a perspective view of a toner container according to the second embodiment of the present invention, and FIG. 37 is a cut-away side view of a head part of the toner container shown in FIG. 36. In the second embodiment of the present invention, as the reference number of the toner container, the same reference number 32Y as that in the first embodiment of the present invention is used.

When the second embodiment of the present invention is compared with the first embodiment of the present invention, in the second embodiment of the present invention, the head part of the toner container 32Y has a circular cone shape, and the scrapers 32Y30 are not positioned at the opening of the container main body 32Y2.

As shown in FIGS. 36 and 37, similar to the first embodiment of the present invention, in the second embodiment of the present invention, the toner container 32Y includes the cap section 32Y1 and the container main body 32Y2 as relatively large components.

In the second embodiment of the present invention, as described above, the head part of the container main body 32Y has the circular cone shape toward the opening of the container main body 32Y2. As shown in FIG. 37, an inclination angle θ2 of a spiral-shaped protrusion 32Y2*a* formed at the circular cone-shaped part is smaller than an inclination angle θ1 of a spiral-shaped protrusion 32Y2*a* formed at the other parts of the container main body 32Y2 (θ1>θ2).

With this, when toners reach the circular cone-shaped part by being carried toward the opening of the container main body 32Y2, since the moving speed of the toners is accelerated, stagnation of the toners at the circular cone-shaped part whose space is small can be prevented.

In the second embodiment of the present invention, since the circular cone-shape part is formed, the toners are led to the position of the inner diameter position of the sealing member 32Y20*b* of the cap section 32Y1 from the opening of the container main body 32Y2 on a slope, and the toners are smoothly carried to the toner outlet W. Therefore, the toners can be carried to the toner outlet W without including the scrapers 32Y30. When the cost of the scrapers 32Y30 is affordable, the scrapers 32Y30 are effective to stir the toners at positions surrounding the toner outlet W and the opening of the container main body 32Y2.

Similar to the first embodiment of the present invention, in the second embodiment of the present invention, in order that the toner container 32Y can be operated by being attached to the toner supplying device 60Y, the cap section 32Y1 of the toner container 32Y includes the toner outlet W, the shutter member 32Y1*a*, the guiding member 32Y1*g*, the contacting section 32Y1*h*, the pushing member 32Y1*k*, the electronic substrate 32Y1*c*, the protrusion member 32Y1*d*, the protrusion member 32Y1*e*, the guide rib 32Y1*f*, the handle part 32Y1*d*, the elastic member 125, the brim section 32Y1*a*1, the elastic part 32Y1*a*2, the stopping part 32Y1*a*3, the protrusions 32Y1*a*4, the protrusions 32Ya10, and the slope part 32Y1*p*.

When the shutter member 32Y1*a* is opened (closed) (the cap section 32Y1 of the toner container 32Y is rotated), the shutter 89 (of the image forming apparatus main body side) of the toner supplying device 60Y is pushed by the cap section 32Y1 (the guiding member 32Y1*g* and the contacting section 32Y1*h*), and the toner supplying opening 60Ya is opened (closed).

When the toner container 32Y is put on an arbitrary flat surface in a state where the shutter member 32Y1*a* closes the toner outlet W, the electronic substrate 32Y1*c* does not contact the flat surface so that the shutter member 32Y1*a* and the protrusion member 32Y1*d* become the supporting points contacting the flat surface.

Similar to the first embodiment of the present invention, in the second embodiment of the present invention, as described in the first embodiment of the present invention, the antennas 121Y, 121M, 121C, and 121K for facing the electronic substrates 32Y1*c*, 32M1*c*, 32C1*c*, and 32K1*c* positioned on the corresponding circumferential surfaces of the toner containers 32Y, 32M, 32C, and 32K arrayed on the supporting part 115 of the image forming apparatus main body 100 are positioned on the antenna substrate 120. Therefore, communications between the electronic substrates 32Y1*c*, 32M1*c*, 32C1*c*, and 32K1*c* and the corresponding antennas 121Y, 121M, 121C, and 121K are performed in good conditions. Further, the image forming apparatus main body 100 (the toner supplying devices 60Y, 60M, 60C, and 60K) is not caused to be great in size in the toner container inserting direction, and as a result, can be manufactured at low cost with relatively low-cost components, and the assembling efficiency of the image forming apparatus main body 100 can be high.

Similar to the first embodiment of the present invention, in the second embodiment of the present invention, as described in the first embodiment of the present invention, when the shutter member 32Y1*a* of the toner container 32Y is opened, the end surface 32Y1*g*1 of the guiding member 32Y1*g* pushes the shutter 89 together with the opening operation of the shutter member 32Y1*a*. With this, the toner supplying opening 60Ya of the toner supplying device 60Y is opened, and the toner outlet W of the toner container 32Y is connected to the toner supplying opening 60Ya. Therefore, toners are smoothly supplied to the toner supplying device 60Y from the toner container 32Y. Even if toners are dropped from the toner container 32Y to a part surrounding the toner supplying opening 60Ya, the dropped toners are not visible from a user, and the unsatisfying impression is not given to the user.

Third Embodiment

Figure 38:
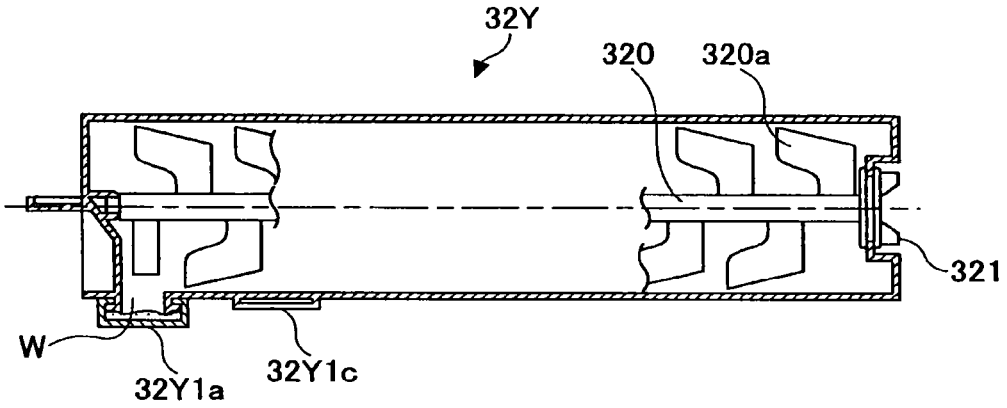
FIG. 38 is a cut-away side view of a toner container according to a third embodiment of the present invention.
Figure 39:
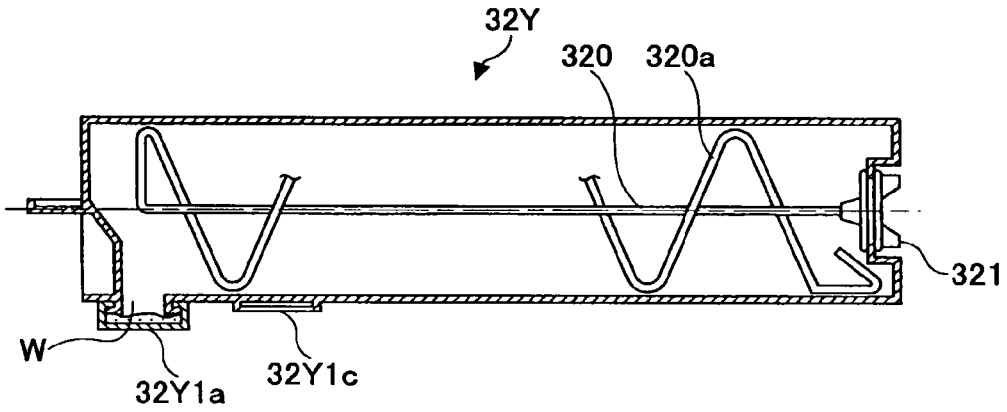
FIG. 39 is a cut-away side view of another toner container according to the third embodiment of the present invention.

Referring to FIGS. 38 and 39, a third embodiment of the present invention is described. FIG. 38 is a cut-away side view of a toner container according to the third embodiment of the present invention and FIG. 39 is a cut-away side view of another toner container according to the third embodiment of the present invention. In the third embodiment of the present invention, as the reference number of the toner container, the same reference number 32Y as that in the first embodiment of the present invention is used.

When the third embodiment of the present invention is compared with the first embodiment of the present invention, in the third embodiment of the present invention, a carrying member 320 is formed inside the toner container 32Y.

As shown in FIG. 38, the toner container 32Y includes a container main body which is secured to the image forming apparatus main body 100 when the container main body is attached to the image forming apparatus main body 100 (the toner supplying device 60Y) as a relatively large component, and the carrying member 320 formed inside the container main body.

The carrying member 320 is rotatably supported by two parts of a head part and a tail part of the container main body. The carrying member 320 includes plural stirring blades 320*a* and an engaging member 321 (driven coupling member) which engages with the driving coupling member 90. With this, the carrying member 320 is rotated in a predetermined direction by receiving a driving force from the driving coupling member 90 of the image forming apparatus main body 100, and carries toners in the toner container 32Y in the long length direction (the left direction in FIG. 38). Consequently, the toners are discharged from the toner outlet W to the toner tank 61Y.

As shown in FIG. 39, the carrying member 320 can be rotatably supported by one part of the tail part of the container main body.

In the third embodiment of the present invention, the shutter member 32Y1*a* for opening or closing the toner outlet W, the electronic substrate 32Y1*c*, and so on are formed on the circumferential surface of the toner container 32Y (the container main body).

Figure 49:
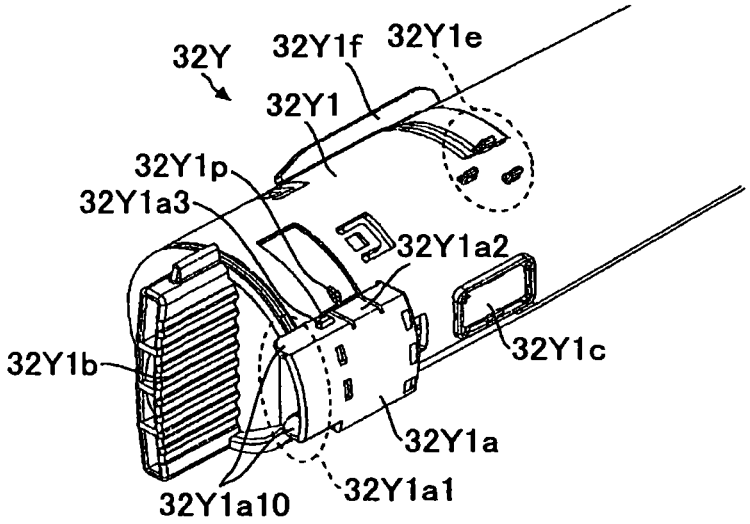
FIG. 49 is a perspective view of the head part of the toner container according to the third embodiment of the present invention.

In addition, as shown in FIG. 49, similar to the first embodiment of the present invention, in the third embodiment of the present invention, in order that the toner container 32Y can be operated by being attached to the toner supplying device 60Y, the toner container 32Y includes the toner outlet W, the shutter member 32Y1*a*, the guiding member 32Y1*g*, the contacting section 32Y1*h*, the pushing member 32Y1*k*, the electronic substrate 32Y1*c*, the protrusion member 32Y1*d*, the protrusion member 32Y1*e*, the guide rib 32Y1*f*, the handle part 32Y1*d*, the elastic member 125, the brim section 32Y1*a*1, the elastic part 32Y1*a*2, the stopping part 32Y1*a*3, the protrusions 32Y1*a*4, the protrusions 32Ya10, and the slope part 32Y1*p*.

In the first embodiment of the present invention, when the toner container 32Y is put on an arbitrary flat surface, the electronic substrate 32Y1*c* does not contact the flat surface so that the shutter member 32Y1*a* and the protrusion member 32Y1*d* become the supporting points contacting the flat surface. However, in the third embodiment of the present invention, the shutter member 32Y1*a* and one end of the toner container 32Y form supporting points and the electronic substrate 32Y1*c* does not contact the flat surface.

Figure 50:
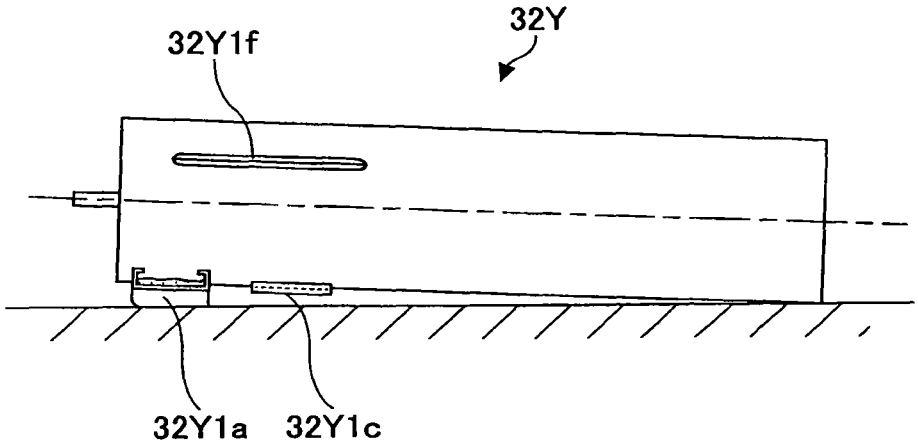
FIG. 50 is a diagram showing the toner container in a state where the toner container is put on a flat surface.

That is, as shown in FIG. 50, the electronic substrate 32Y1*c* is positioned inside a region of a virtual line extending from the shutter member 32Y1*a* to the one end of the toner container 32Y (the virtual line is the floor surface in FIG. 50). In the third embodiment of the present invention, in addition to the above, the protrusion member 32Y1*d* can be formed.

In addition, in the third embodiment of the present invention, as described in the first embodiment of the present invention, the container main body of the toner container 32Y includes the toner outlet W, the shutter member 32Y1*a*, the guiding member 32Y1*g*, the contacting section 32Y1*h*, the pushing member 32Y1*k*, the electronic substrate 32Y1*c*, and so on.

When the shutter member 32Y1*a* is opened (closed) (the toner container 32Y is rotated), the shutter 89 (of the image forming apparatus main body side) of the toner supplying device 60Y is pushed by the container main body (the guiding member 32Y1*g* and the contacting section 32Y1*h*), and the toner supplying opening 60Ya is opened (closed).

Similar to the first embodiment of the present invention, in the third embodiment of the present invention, as described in the first embodiment of the present invention, the antennas 121Y, 121M, 121C, and 121K for facing the electronic substrates 32Y1*c*, 32M1*c*, 32C1*c*, and 32K1*c* positioned on the corresponding circumferential surfaces of the toner containers 32Y, 32M, 32C, and 32K arrayed on the supporting part 115 of the image forming apparatus main body 100 are positioned on the antenna substrate 120.

Therefore, communications between the electronic substrates 32Y1*c*, 32M1*c*, 32C1*c*, and 32K1*c* and the corresponding antennas 121Y, 121M, 121C, and 121K are performed in good conditions. Further, the image forming apparatus main body 100 (the toner supplying devices 60Y, 60M, 60C, and 60K) is not caused to be great in size in the toner container inserting direction, can be manufactured at low cost with relatively low-cost components, and the assembling efficiency of the image forming apparatus main body 100 can be high.

Similar to the first embodiment of the present invention, in the third embodiment of the present invention, as described in the first embodiment of the present invention, when the shutter member 32Y1*a* of the toner container 32Y is opened, the end surface 32Y1*g*1 of the guiding member 32Y1*g* pushes the shutter 89 together with the opening operation of the shutter member 32Y1*a*. With this, the toner supplying opening 60Ya of the toner supplying device 60Y is opened, and the toner outlet W of the toner container 32Y is connected to the toner supplying opening 60Ya. Therefore, toners are smoothly supplied to the toner supplying device 60Y from the toner container 32Y. Even if toners are dropped from the toner container 32Y to a part surrounding the toner supplying opening 60Ya, the dropped toners are not visible from a user, and the unsatisfying impression is not given to the user.

In the first through third embodiments of the present invention, only toners are contained in the toner containers 32Y, 32M, 32C, and 32K. However, when an image forming apparatus uses a two-component developer, the toner containers 32Y, 32M, 32C, and 32K can contain corresponding two-component developers formed of toners and carrier particles (toner carrier). In this case, the same effects as those in the first through third embodiments of the present invention can be obtained.

In addition, in the first through third embodiments of the present invention, a part or all of the corresponding image forming sections 6Y, 6M, 6C, and 6K can be included in the corresponding process cartridges. In this case, the same effects as those in the first through third embodiments of the present invention can be obtained.

In addition, in FIGS. 1 and 13, the toner carrying route formed of the toner tank 61Y, the toner carrying screw 62Y, the toner carrying tube 63Y, and the toner dropping route 64Y of the toner supplying device 60Y is formed in a И -shaped structure viewed from the direction perpendicular to the plane of the paper of FIG. 13. In addition, in FIG. 1, the toner supplying device 60Y is at the left upper position of the image forming section 6Y (process cartridge), and the toner container 32Y is also at the left upper position of the image forming section 6Y. That is, for example, the toner container 32M, and a toner tank and the upstream side of a toner carrying section for magenta are not positioned above the image forming section 6M, but above the image forming section 6Y.

With this, in a tandem type image forming apparatus in which plural image forming sections 6Y, 6M, 6C, and 6K are arrayed in parallel, when the image forming section 6Y (process cartridge) is attached to or detached from the image forming apparatus main body 100, the image forming section 6Y and the toner supplying device 60Y do not interfere with each other. Therefore, in the image forming apparatus main body 100, the length in the vertical direction from the toner containers 32Y, 32M, 32C, and 32K to the image forming sections 6Y, 6M, 6C, and 6K can be shortened, and the variation of the amount of toners to be supplied to the corresponding developing devices 5Y, 5M, 5C, and 5K can be prevented.

Further, the present invention is not limited to the specifically disclosed embodiments, and variations and modifications may be made without departing from the scope of the present invention. That is, in the embodiments of the present invention, the number of elements, the positions of the corresponding elements, and the shapes of the corresponding elements are not limited to the specifically disclosed embodiments.

The invention claimed is:

1. A toner container for use with an image forming apparatus, the toner container comprising:

a toner storing section having a cylindrical shape and a length;

a toner outlet at a circumferential surface of the toner container for discharging toner in the toner container to a toner supply opening of the image forming apparatus;

a shutter member at a circumferential surface of the toner container for opening or closing the toner outlet due to rotation of the toner container in a state where the toner container is attached to the image forming apparatus; and a brim section in the shutter member and extending in a direction along the length of the toner container, the brim section being at an end of the toner container, when the shutter member opens the toner outlet, wherein the brim section covers an opening of a toner receiving section of the image forming apparatus when the toner container is attached to the image forming apparatus; and wherein the toner receiving section of the image forming apparatus receives toner dropped from a surface of the shutter member when the toner container is detached from the image forming apparatus.

2. The toner container as claimed in claim 1, wherein the shutter member has a protrusion unit in the brim section, for preventing the shutter member from being assembled with the toner container in a wrong direction.

3. The toner container as claimed in claim 1, further comprising:

a cap section which is secured to the image forming apparatus when the toner container is attached to the image forming apparatus; and a container main body to be connected to the cap section for carrying the toner by being rotated in a predetermined direction when a driving force is received from the image forming apparatus; wherein the cap section includes the toner outlet, the shutter member, and a guiding member.

4. The toner container as claimed in claim 1, further comprising:

a carrying member for carrying the toner in the toner storing section by being rotated in a predetermined direction when a driving force is received from the image forming apparatus.

5. The toner container as claimed in claim 1, wherein:

the shutter member has two protrusions facing a circumferential surface of the toner container at positions separated from each other.

6. The toner container as claimed in claim 5, wherein:

the two protrusions of the shutter member are at least at an end of the shutter member in the direction along the length of the toner container.

7. The toner container as claimed in claim 1, wherein:

a restricting portion of the shutter member contacts with a protrusion provided on the circumferential surface of the toner container, and restricts a movement of the shutter member, and releases the movement when a force of a predetermined amount or more is applied to the shutter member.

8. The toner container as claimed in claim 1, wherein the toner container is to be inserted into an image forming apparatus with a side at which a toner outlet is provided inserted after another side opposite thereto.

9. The toner container as claimed in claim 8, wherein the toner container becomes attached by rotating clockwise after the insertion.

10. The toner container as claimed in claim 1, wherein the toner container is in communication with a toner supplying opening of the image forming apparatus when the toner container is attached to the image forming apparatus and the toner outlet is facing downward in a vertical direction.

11. An image forming apparatus comprising:

the toner container as claimed in claim 1.

12. The toner container as claimed in claim 1, wherein the toner supply opening is different from the opening of the toner receiving section.

13. The toner container as claimed in claim 1, further comprising:

a handle at the end of the toner container at which the brim section is disposed.

14. The toner container as claimed in claim 13, wherein:

the handle is attached to the toner container at a surface perpendicular to the length of the toner storing section.

15. The toner container as claimed in claim 1, wherein:

the brim section extends beyond the end of the toner container.

16. The toner container as claimed in claim 15, wherein:

the brim section extends beyond the end of the toner container when the shutter member is both opening and closing the toner outlet.

17. The toner container as claimed in claim 1, wherein:

the shutter member moves in a path of an arc along the circumferential surface of the toner container, to open and close the toner outlet.

* * * * *